US011142983B2

(12) United States Patent
Thomas

(10) Patent No.: US 11,142,983 B2
(45) Date of Patent: Oct. 12, 2021

(54) APPARATUS FOR SUBSEA EQUIPMENT

(71) Applicant: Sean P. Thomas, Houston, TX (US)

(72) Inventor: Sean P. Thomas, Houston, TX (US)

( * ) Notice: Subject to any disclaimer, the term of this patent is extended or adjusted under 35 U.S.C. 154(b) by 0 days.

(21) Appl. No.: 16/395,172

(22) Filed: Apr. 25, 2019

(65) Prior Publication Data

US 2019/0330952 A1 Oct. 31, 2019

Related U.S. Application Data

(60) Provisional application No. 62/663,869, filed on Apr. 27, 2018.

(51) Int. Cl.

| | |
|---|---|
| ***E21B 33/035*** | (2006.01) |
| ***E21B 34/04*** | (2006.01) |
| ***E21B 33/068*** | (2006.01) |
| *E21B 41/02* | (2006.01) |

(52) U.S. Cl.

CPC ..... *E21B 33/035* (2013.01); *E21B 33/068* (2013.01); *E21B 34/04* (2013.01); *E21B 41/02* (2013.01)

(58) Field of Classification Search

CPC ..... E21B 33/035; E21B 33/068; E21B 34/04; E21B 41/02

USPC ..... 166/368

See application file for complete search history.

(56) References Cited

U.S. PATENT DOCUMENTS

| | | | | |
|---|---|---|---|---|
| 6,845,815 B2 * | 1/2005 | Hergarden | ..... | E21B 33/037 166/75.13 |
| 2014/0158367 A1 * | 6/2014 | Stokes | ..... | E21B 29/005 166/368 |

* cited by examiner

*Primary Examiner* — Matthew R Buck
*Assistant Examiner* — Patrick F Lambe
(74) *Attorney, Agent, or Firm* — Nolte Lackenbach Siegel

(57) ABSTRACT

An apparatus for installation to a subsea equipment mandrel or hub, including a body having a cylindrical sidewall defining one or more receptacles and a locking system to couple the body to the mandrel or hub. The locking system may include one or more locking assemblies received within a respective receptacle and coupled to the cylindrical sidewall. Each locking assembly may include a locking body, a locking collar, an annular seal, an actuator, and a locking pin. The annular seal may be seated within an annular groove and configured to engage the shoulder of a receptacle in a sealing relationship, and the locking collar may couple the locking body to the cylindrical sidewall. The actuator may be adjustably coupled to the locking body and configured to move radially. A locking pin may be configured to selectively engage the angled shoulder surface of the mandrel or hub.

25 Claims, 17 Drawing Sheets

APPARATUS FOR SUBSEA EQUIPMENT

CROSS-REFERENCE TO RELATED APPLICATIONS

This application claims the benefit of U.S. Prov. Appl. No. 62/663,869, filed Apr. 27, 2018, the content of which is incorporated herein by reference in its entirety to the extent consistent with the present application.

BACKGROUND

Subsea hydrocarbon wells are typically drilled and constructed in subsea earthen formations from mobile offshore drilling units using subsea wellhead systems. FIG. 1 illustrates a cross sectional view of an example subsea wellhead assembly 100 having an upper portion, illustrated as a mandrel 110, known to those of ordinary skill in the art. As shown, the subsea wellhead assembly 100 includes a high pressure wellhead housing 102, a low pressure wellhead housing 104, and conductor pipe 106 extending from the low pressure wellhead housing 104.

Construction of a hydrocarbon well generally starts by installing the low pressure wellhead housing 104 and conductor pipe 106 in the seabed 108 via drilling, jetting or pile driving processes. During subsequent drilling operations, varying casing strings and additional wellhead components including the high pressure wellhead housing 102 are installed in the hydrocarbon well. The high pressure wellhead housing 102 is configured to carry the loads transferred to the seabed 108 and the pressures contained within the hydrocarbon well. During drilling of the hydrocarbon well, the high pressure wellhead housing 102 is connected to a blowout preventer (BOP) device (not shown) using a wellhead connector (not shown). After drilling is completed and in preparation for production of hydrocarbons, a production system (not shown) will be connected to the high pressure wellhead housing 102 using another wellhead connector (not shown).

The mandrel 110 may include structural features and sealing surfaces that interface with the appropriate wellhead connector. Generally, these structural features and sealing surfaces include one or more circumferential grooves (four shown 112) that define one or more angled shoulder surfaces (four shown 113) formed in a main outer circumferential surface 114 of the mandrel 110 to provide connection means to the wellhead connector. The mandrel 110 further defines an upper outer circumferential surface 115 above the circumferential grooves 112 and one or more conical sealing surfaces 116 near the top of an inner circumferential surface 118 of the mandrel. The conical sealing surfaces 116 are typically referred to as ring gasket sealing surfaces and are configured to interface with a metal ring gasket (not shown) and wellhead connector to seal liquids and gases at varying pressures. The mandrel 110 further includes one or more top faces (one shown 120). The inner circumferential surface 118 of the high pressure wellhead housing 102 may be further defined by one or more sealing surfaces 130, locking grooves 132, and load shoulders 134, located below the conical sealing surface 116. Casing hangers, tubing hangers, lockdown sleeves, and similar components (not shown) may be landed, locked and sealed to the inner circumferential surface 118 during well construction, with each respective component defining additional sealing surfaces and locking features within the bore of those components.

FIG. 2 illustrates a cross sectional view of an upper portion for a subsea wellhead, subsea tree, or similar subsea equipment, illustrated as a hub 210, known to those of ordinary skill in the art. The hub 210 has an outward step above the main outer circumferential surface 214 that defines one large, angled shoulder surface 113 and an upper outer circumferential surface 115. Similar to the mandrel 110, the hub 210 further includes one or more conical sealing surfaces (one shown 116) near the top of an inner circumferential surface 118 of the hub and one or more top faces (two shown 120) of the hub.

FIG. 3 illustrates a cross sectional view of an upper portion for a subsea wellhead, subsea tree, or similar subsea equipment, illustrated as a dual hub 310, known to those of ordinary skill in the art. The dual hub 310 includes a main outer circumferential surface 114 that defines two circumferential grooves 112, two large angled shoulder surfaces 113, and an upper outer circumferential surface 115. Similar to the mandrel 110 and the hub 210, the dual hub 310 further includes one or more conical sealing surfaces (one shown 116) near the top of an inner circumferential surface 118 of the hub and one or more top faces (two shown 120). Similar mandrel and hub designs are used for pressure-containing connections for subsea trees, subsea manifolds, subsea pipelines, etc., in varying sizes ranging from 2 inch nominal through 48 inch nominal, which may be referred to generally as subsea equipment mandrels and hubs.

During construction of the hydrocarbon well, there are a number of circumstances where an oil company or drilling contractor may temporarily halt drilling or construction activities, an event commonly referred to as a temporary abandonment. Such a temporary abandonment may be a fairly short period lasting weeks or months, or alternatively the temporary abandonment may last several years. Left unprotected during the temporary abandonment, those of skill in the art will appreciate that the mandrel 110 may be susceptible to damage from external objects and, in addition, corrosion and deposits resulting from the exposure of the mandrel 110 to the corrosive seawater and other damaging elements of the subsea environment. For example, corrosion and/or deposits may form on the conical sealing surface 116 resulting in an inability to form a seal at the interface with the metal ring gasket of the wellhead connector to seal liquids and gases at varying pressures. In addition, corrosion or deposits may form on the internal sealing surfaces 130 and locking features 132 of the inner circumferential surface 118, or the internal sealing surfaces and locking features of the components (not shown) installed to the inner circumferential surface 118. Further, corrosion or deposits may form on the angled shoulder surfaces 113 on the exterior portion of the mandrel 110, resulting in an inability to provide a suitable connection means to the wellhead connector.

Accordingly, it has been a common practice in the offshore industry to install a temporary, external protective cap assembly to the mandrel or hub of a subsea wellhead assembly 100, subsea tubing head spool, or subsea tree during the temporary abandonment of a hydrocarbon well. These subsea protective cap assemblies are typically referred to as corrosion caps, debris caps, trash caps, or temporary abandonment caps. In addition to physically preventing external objects and debris from contacting the mandrel or hub and entering the bore 122, the protective cap assemblies may be configured to allow for the injection and retention of a corrosion inhibitor fluid to reduce corrosion, deposits, and related damage to the internal sealing surfaces and locking features of the mandrel or hub. Protective cap assemblies are also typically installed to the mandrel or hub of a subsea production tree for long-term installation. Protective cap assemblies for subsea trees may be very similar to the subsea wellhead cap, or may have a specialized configuration depending on the subsea tree design. Similar protective cap assemblies in varying sizes may be used for other subsea equipment mandrels and hubs for subsea trees, subsea manifolds, subsea jumpers, subsea pipelines, and similar subsea equipment.

Subsea protective cap assemblies have traditionally been constructed from steel. As the weight of the protective cap assemblies constructed from steel may often exceed six hundred pounds, these protective cap assemblies are typically installed by a drilling rig using drill pipe or a wireline hoist. Although these steel-constructed protective cap assemblies are generally inexpensive to design and manufacture, the costly expense of drilling rig time to install such protective cap assemblies has led to a need for an improved protective cap assembly. Accordingly, a more recent development has been the utilization of lightweight protective cap assemblies that can be installed using a remotely operated vehicle (ROV), which avoids the costly expense of drilling rig time to install the protective cap assembly. To allow for ROV installation, the protective cap assembly is typically limited to about 150 to 200 pounds maximum weight as provided with the protective cap assembly immersed in seawater.

The slight internal pressures in the protective cap assembly created during injection of corrosion inhibitor fluid may create substantial lifting forces which may easily exceed the weight of the protective cap assembly such that the cap may try to lift off the mandrel. If the cap is coupled to the mandrel with a locking feature, any clearances in the connection means of the protective cap assembly to the mandrel may allow the protective cap to lift slightly, and may compromise the seal between the protective cap assembly and the mandrel 110, and allow the corrosion inhibitor fluid to drain from the cap. Accordingly, in such instances, corrosive seawater may be permitted to contact the sealing surfaces and locking features of the inner circumferential surface 118 of the mandrel 110, thereby damaging these sealing surfaces and locking features.

In an effort to retain the protective cap assembly in contact with and coupled to the mandrel 110, protective cap assemblies may employ passive or active locking systems. In one conventional passive locking system, spring-loaded shear pins, constructed of a metal, may extend from the protective cap assembly to engage one or more of the circumferential grooves 112 of the mandrel. As such a locking system provides no active means of disengaging the metal shear pins from the mandrel 110, very high loads (e.g., 80,000 pounds) may be generated in some instances to shear the metal shear pins in order to remove the protective cap assembly. As such a load amount typically exceeds the capability of a wireline hoist, a protective cap assembly utilizing such a locking system is typically removed using drill pipe, which as noted above results in a costly expense. Further, the fragments of the metal shear pins sheared therefrom during removal may become lodged between the protective cap assembly and the mandrel, thereby jamming the protective cap assembly to the mandrel or causing further damage to the mandrel during removal of the protective cap assembly.

Accordingly, active locking systems may be employed utilizing ROVs to address the drawbacks provided above with respect to the passive locking systems. In one conventional active locking system, locking pins may be engaged and disengaged with an angled shoulder surface 113 of the mandrel 110 by an ROV. Typically, the ROV will engage the locking pins with an angled shoulder surface 113 with a rotational motion via the use of a hydraulic wrist motor. As the hydraulic wrist motor of the ROV may generate high torque outputs (e.g., 150 ft-lbs) and may typically have limited fine control of the wrist motor torque outputs, there is a risk of applying excessive torque to the locking pins during engagement, thereby damaging the protective cap body, the locking assembly, or the angled shoulder surface 113. Such damage may result in a poor connection between the protective cap assembly and the mandrel 110, may thereby compromise the seal between the protective cap assembly and the mandrel 110, and allow the corrosion inhibitor fluid to drain from the cap.

What is needed, therefore, is a protective cap assembly capable of being coupled to a subsea equipment mandrel or hub while maintaining a sealing relationship with the mandrel or hub and receiving a corrosion inhibitor fluid therein to prevent corrosion and/or the formation of deposits on the mandrel or hub.

SUMMARY

Embodiments of the disclosure may provide an apparatus for installation to a subsea equipment mandrel or hub disposed in a subsea environment. The apparatus may include a body and a locking system configured to couple the body to the mandrel or hub. The body may include a body longitudinal axis and a cylindrical sidewall extending axially along the body longitudinal axis. The cylindrical sidewall may define one or more receptacles, and the cylindrical sidewall may form a respective shoulder within each receptacle in the cylindrical sidewall. The locking system may include one or more locking assemblies. Each locking assembly may be configured to be received within a respective receptacle and coupled to the cylindrical sidewall. Each locking assembly includes a locking body, a first annular seal, a first locking collar, an actuator, and a locking pin. The locking body may include a main locking body portion and a secondary locking body portion extending from the main locking body portion. The locking body may further define an annular groove near the junction of the main locking body portion and the secondary locking body portion. The first annular seal may be seated within the annular groove and configured to engage the shoulder in a sealing relationship therewith. The first locking collar may be configured to couple the locking body to the cylindrical sidewall, such that the first locking collar may be coupled with the secondary locking body portion and seated against an interior face of the shoulder, and a main locking body interior surface is seated against an exterior face of the shoulder. The actuator may include a main actuator portion and may be adjustably coupled to the locking body and configured to move radially toward or away from an angled shoulder surface of the mandrel or hub. The locking pin may be integral or coupled with the actuator and configured to selectively engage the angled shoulder surface of the mandrel or hub, such that when extended, the locking pin couples the body to the mandrel or hub.

Embodiments of the disclosure may provide an apparatus for installation to a subsea equipment mandrel or hub disposed in a subsea environment. The apparatus may include a body and a locking system configured to couple the body to the mandrel or hub. The body may include a body longitudinal axis and a cylindrical sidewall extending axially along the body longitudinal axis. The cylindrical sidewall may define one or more receptacles, and the cylindrical sidewall may form a respective shoulder within each receptacle in the cylindrical sidewall. The locking system may include one or more locking assemblies. Each locking assembly may be configured to be received within a respective receptacle and coupled to the cylindrical sidewall. Each locking assembly includes a locking body, a first locking collar, an actuator, and a locking pin. The locking body may include a main locking body portion and a secondary locking body portion extending from the main locking body portion. The main locking body portion may further include a main locking body portion exterior surface and a main locking body interior surface. The first locking collar may be configured to couple the locking body to the cylindrical sidewall, such that the first locking collar may be coupled with the secondary locking body portion and seated against an interior face of the shoulder, and the main locking body portion interior surface is seated against an exterior face of the shoulder. The actuator may be adjustably coupled to the locking body and configured to move radially toward or away from an angled shoulder surface of the mandrel or hub. The actuator may include a main actuator portion having an outer surface and an inner surface, the outer surface of the main actuator portion being adjustably coupled to the locking body, and the inner surface of the main actuator portion defining an actuator locking pin bore. The locking pin may be coupled with the actuator and configured to selectively engage the angled shoulder surface of the mandrel or hub, such that when extended, the locking pin couples the body to the mandrel or hub. The locking pin may include a locking pin head and a locking pin shaft. The locking pin head may have a first surface and a second surface, the first surface shaped to generally conform to the angled shoulder surface of the mandrel or hub, and the locking pin shaft extending from the second surface of the locking pin head. The locking pin shaft may be configured to be installed to the actuator locking pin bore. The locking pin may define a groove at a location adjacent a junction of the locking pin head and locking pin shaft, and the locking pin may be configured to shear at the location of the groove in the event that a predetermined load rating is exceeded.

Embodiments of the disclosure may provide an apparatus for installation to a mandrel or hub disposed in a subsea environment. The apparatus may include a body and a locking system configured to couple the body to the mandrel or hub. The body may include a body longitudinal axis and a cylindrical sidewall extending axially along the body longitudinal axis. The cylindrical sidewall may define one or more receptacles, and the cylindrical sidewall may form a respective shoulder within each receptacle in the cylindrical sidewall. The locking system may include one or more locking assemblies. Each locking assembly may be configured to be received within a respective receptacle and coupled to the cylindrical sidewall. Each locking assembly includes a locking body, a first locking collar, an actuator, and a locking pin. The locking body may include a main locking body portion and a secondary locking body portion extending from the main locking body portion. The main locking body portion may further include a main locking body portion exterior surface and a main locking body interior surface. The first locking collar may be configured to couple the locking body to the cylindrical sidewall, such that the first locking collar may be coupled with the secondary locking body portion and seated against an interior face of the shoulder, and the main locking body portion interior surface is seated against an exterior face of the shoulder. The actuator may be adjustably coupled to the locking body and configured to move radially toward or away from an angled shoulder surface of the mandrel or hub. The actuator may include a main actuator portion having an outer surface and an inner surface, the outer surface of the main actuator portion being adjustably coupled to the locking body, and the inner surface of the main actuator portion defining an actuator locking pin bore. The locking pin may be coupled with the actuator and configured to selectively engage the angled shoulder surface of the mandrel or hub, such that when extended, the locking pin couples the body to the mandrel or hub. The locking pin may include a locking pin head, a locking pin shaft, and a vent channel. The locking pin head may have a first surface and a second surface, the first surface shaped to generally conform to the angled shoulder surface of the mandrel or hub, and the locking pin shaft extending from the second surface of the locking pin head. The locking pin shaft may be configured to be installed to the actuator locking pin bore. The vent channel may extend through the locking pin head and the locking pin shaft and may be configured to fluidly couple the actuator locking pin bore to the subsea environment.

Embodiments of the disclosure may provide an apparatus for installation to a mandrel or hub disposed in a subsea environment. The apparatus may include a body and a locking system configured to couple the body to the mandrel or hub. The body may include a body longitudinal axis and a cylindrical sidewall extending axially along the body longitudinal axis. The cylindrical sidewall may define one or more receptacles. The locking system may include one or more locking assemblies. Each locking assembly may be configured to be received within a respective receptacle and coupled to the cylindrical sidewall. Each locking assembly includes an actuator and a locking pin. The actuator may be adjustably coupled to the cylindrical sidewall and configured to move radially toward or away from an angled shoulder surface of the mandrel or hub. The actuator may include a main actuator portion having an outer surface and an inner surface, the outer surface of the main actuator portion being adjustably coupled to the cylindrical sidewall, and the inner surface of the main actuator portion defining an actuator locking pin bore. The actuator may also include a remotely operated vehicle (ROV) interface member having an ROV interface member interior surface, where the ROV interface member further includes an exterior ROV interface. The actuator may further include an actuator longitudinal axis, the main actuator portion configured to rotate in a clockwise or a counterclockwise direction about the actuator longitudinal axis to move radially in relation to the mandrel or hub based on the input from an ROV. The locking pin may be coupled with the actuator and configured to selectively engage the angled shoulder surface of the mandrel or hub, such that when extended, the locking pin couples the body to the mandrel or hub. The locking pin may include a locking pin head, a locking pin shaft, and a vent channel. The locking pin head may have a first surface and a second surface, the first surface shaped to generally conform to the angled shoulder surface of the mandrel or hub, and the locking pin shaft extending from the second surface of the locking pin head. The locking pin shaft may be configured to be installed to the actuator locking pin bore. The vent channel may extend through the locking pin head and the locking pin shaft and may be configured to fluidly couple the actuator locking pin bore to the subsea environment.

Embodiments of the disclosure may provide an apparatus for installation to a mandrel or hub disposed in a subsea environment. The apparatus may include a body and a locking system configured to couple the body to the mandrel or hub. The body may include a body longitudinal axis and a cylindrical sidewall extending axially along the body longitudinal axis. The cylindrical sidewall may define one or more receptacles. The locking system may include one or more locking assemblies. Each locking assembly may be configured to be received within a respective receptacle and coupled to the cylindrical sidewall. Each locking assembly includes a locking body, an actuator, an annular component, and a locking pin. The locking body may include a main locking body portion having a main locking body portion exterior surface defining an annular groove. The actuator may be adjustably coupled to the locking body and configured to move radially toward or away from an angled shoulder surface of the mandrel or hub. The actuator may include a main actuator portion, an ROV interface member, and an actuator longitudinal axis. The ROV interface member may extend from the main actuator portion and may have an ROV interface member interior surface, the ROV interface member having an exterior ROV interface. The main actuator portion may be configured to rotate in a clockwise or a counterclockwise direction about the actuator longitudinal axis to move radially in relation to the mandrel or hub based on the input from an ROV. The annular component may be disposed within the annular groove and protruding therefrom. The annular component may be configured to engage the ROV interface member interior surface as the actuator is moved radially toward the angled shoulder surface of the mandrel or hub, and the annular component may be further configured to prevent contact between the ROV interface member interior surface and the main locking body portion exterior surface. The locking pin may be integral or coupled with the actuator and configured to selectively engage the angled shoulder surface of the mandrel or hub, such that when extended, the locking pin couples the body to the mandrel or hub.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
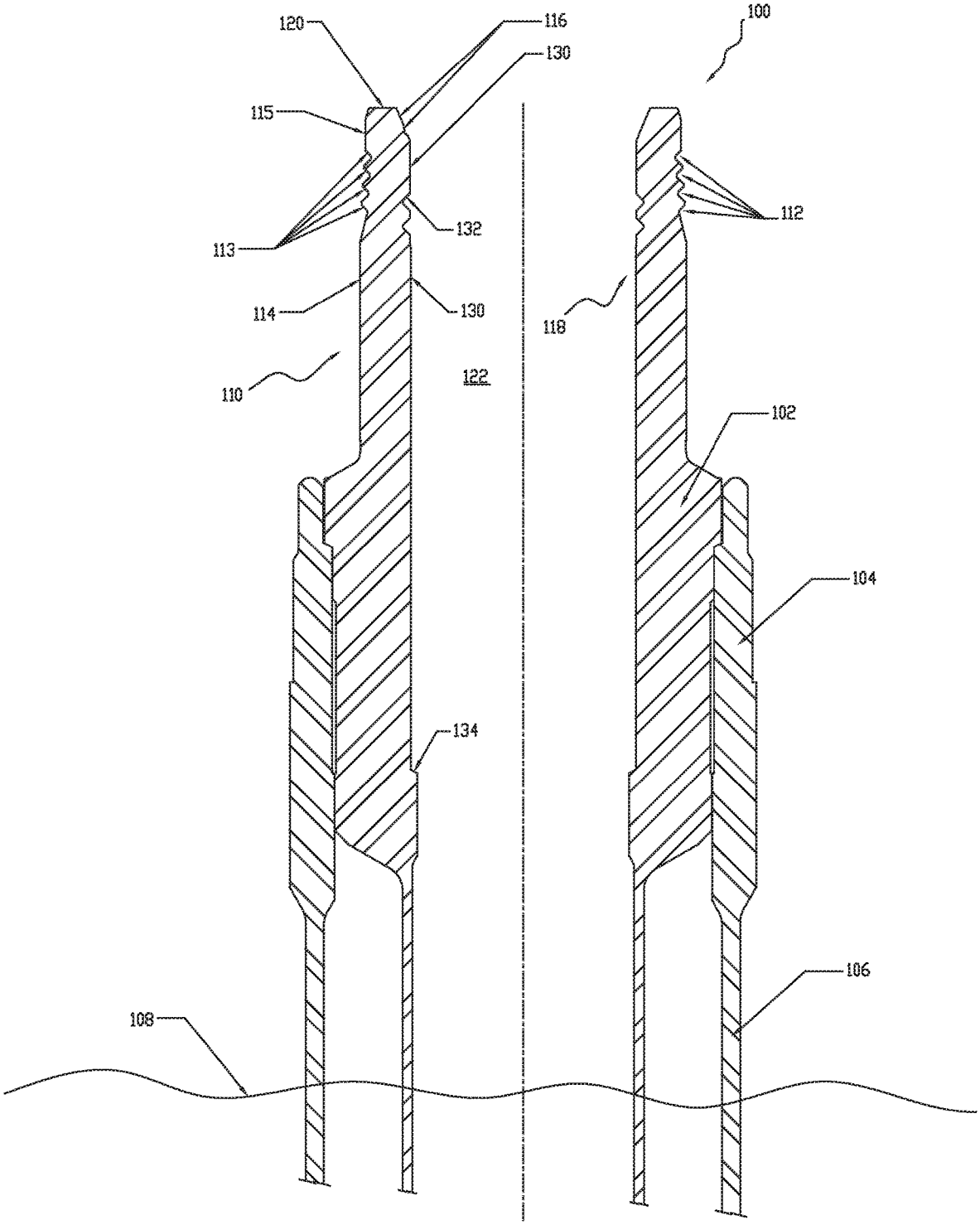
FIG. 1 illustrates a cross sectional view of an example subsea wellhead assembly including a mandrel known to those of ordinary skill in the art.
Figure 2:
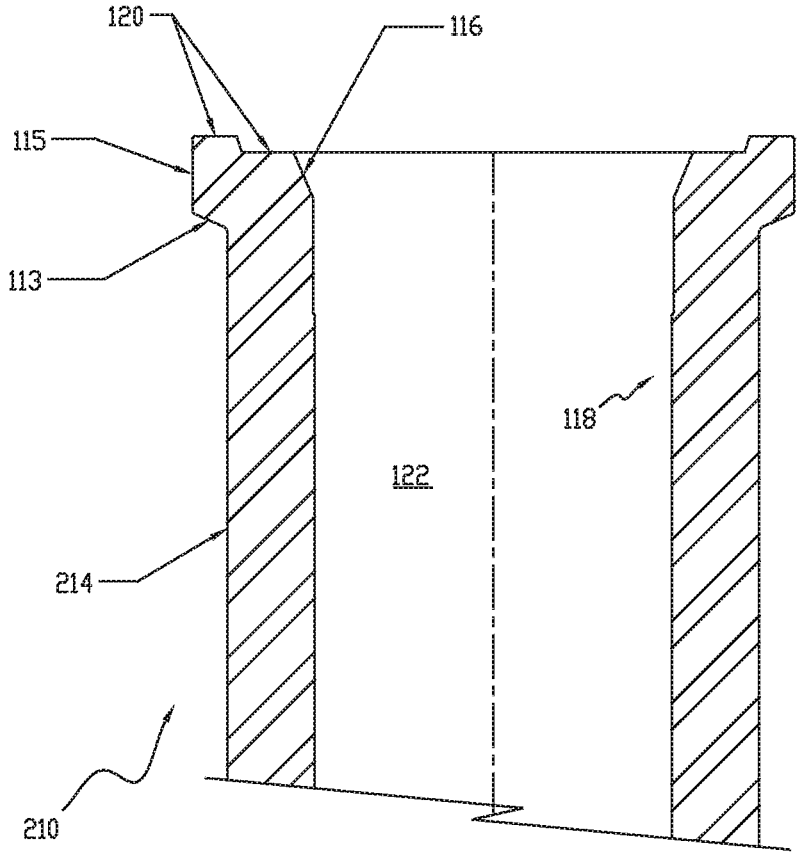
FIG. 2 illustrates a cross sectional view of a hub for a subsea wellhead, subsea tree, or similar subsea equipment, known to those of ordinary skill in the art.
Figure 3:
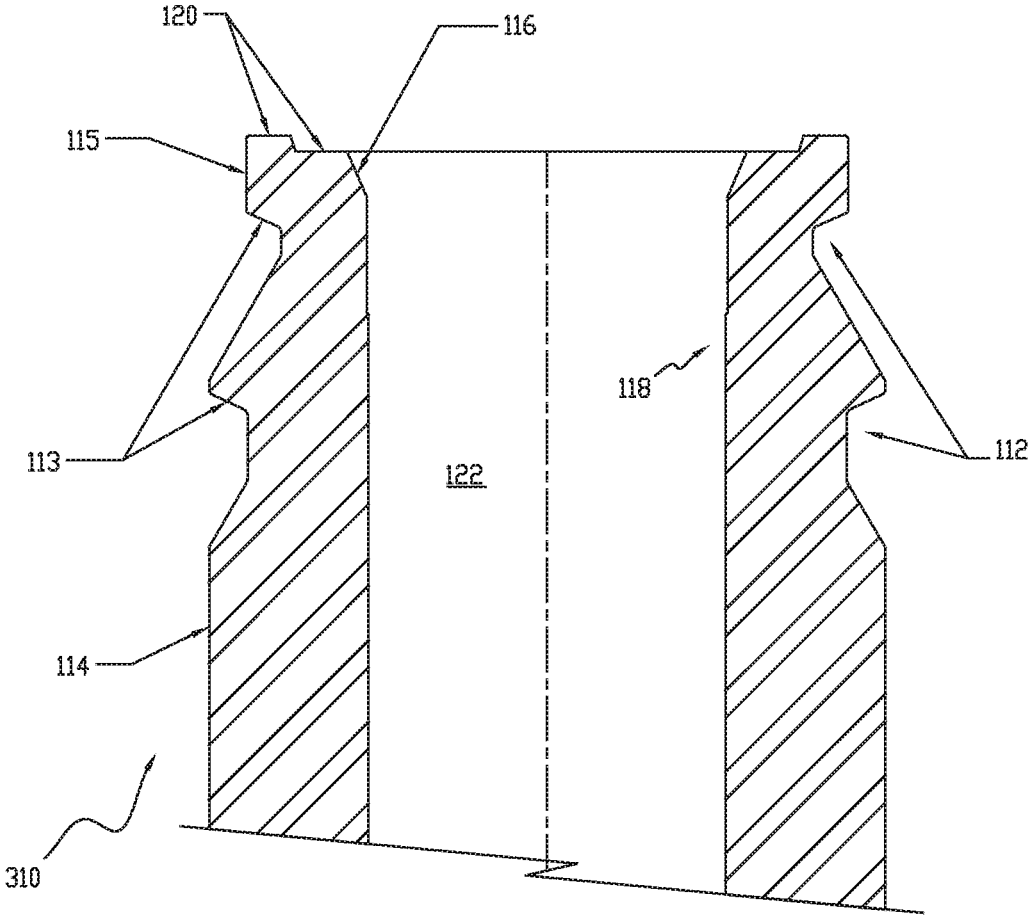
FIG. 3 illustrates a cross sectional view of a dual hub for a subsea wellhead, subsea tree, or similar subsea equipment, known to those of ordinary skill in the art.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Unless otherwise specified, use of the terms "up," "upper," "upward," "above," "top," or other like terms shall be construed as generally toward the surface of the formation or the surface of a body of water as the associated component is arranged therein; likewise, use of "down," "lower," "downward," "below," "bottom," or other like terms shall be construed as generally away from the surface of the formation or the surface of a body of water as the associated component is arranged therein, regardless of the wellbore orientation.

Unless otherwise specified, use of the terms "inner," "inward," "inboard," "interior," "internal," or other like terms shall be construed as generally towards a vertical central axis such as a wellbore central axis; likewise, use of the terms "outer," "outward," "outboard," "exterior," "external," or other like terms shall be construed as generally away from a vertical central axis.

Embodiments of the subsea protective cap assemblies disclosed herein are capable of being coupled to a mandrel or hub of a hydrocarbon well or similar subsea equipment interface. The protective cap assemblies are further configured to maintain a sealing relationship with the mandrel while installed while receiving a corrosion inhibitor fluid therein to prevent corrosion and/or the formation of deposits on the mandrel. To that end, embodiments of the protective cap assemblies of the present disclosure are designed to contain slight internal pressures during and after installation, although the magnitude of pressure is very low (generally about ½ psi to about 100 psi) and is intended primarily to contain corrosion inhibitor fluid injected therein. Since positive pressure containment is necessary to perform the corrosion inhibitor injection procedure, the protective cap assemblies of the present disclosure are designed to carry all or substantially all of the structural loads during the corrosion inhibitor injection procedure, which includes direct internal pressure forces and reactive loads from locking features of the protective cap assembly.

Figure 4:
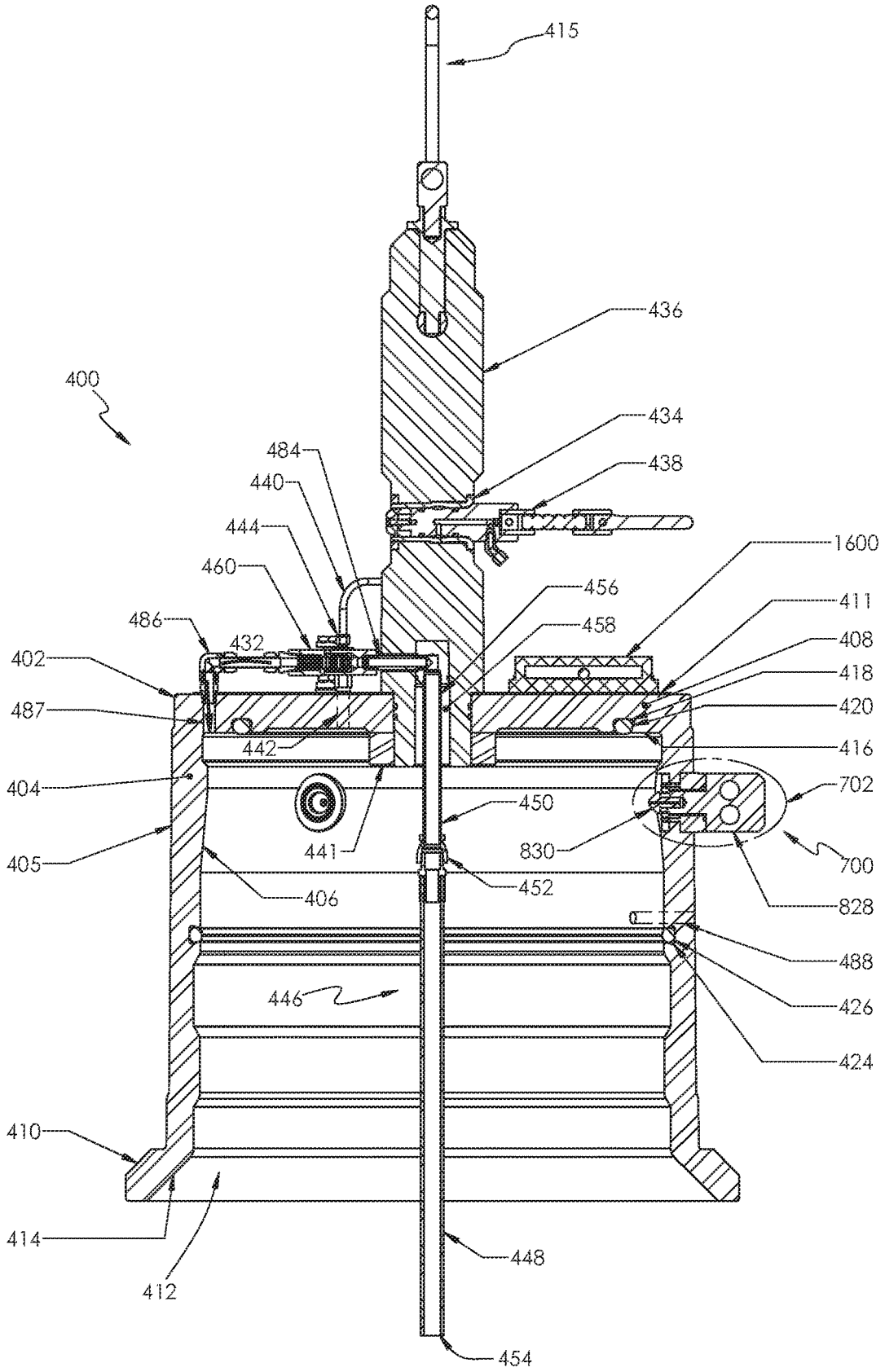
FIG. 4 illustrates a cross sectional view of an example protective cap assembly, according to one or more embodiments of the disclosure.
Figure 5:
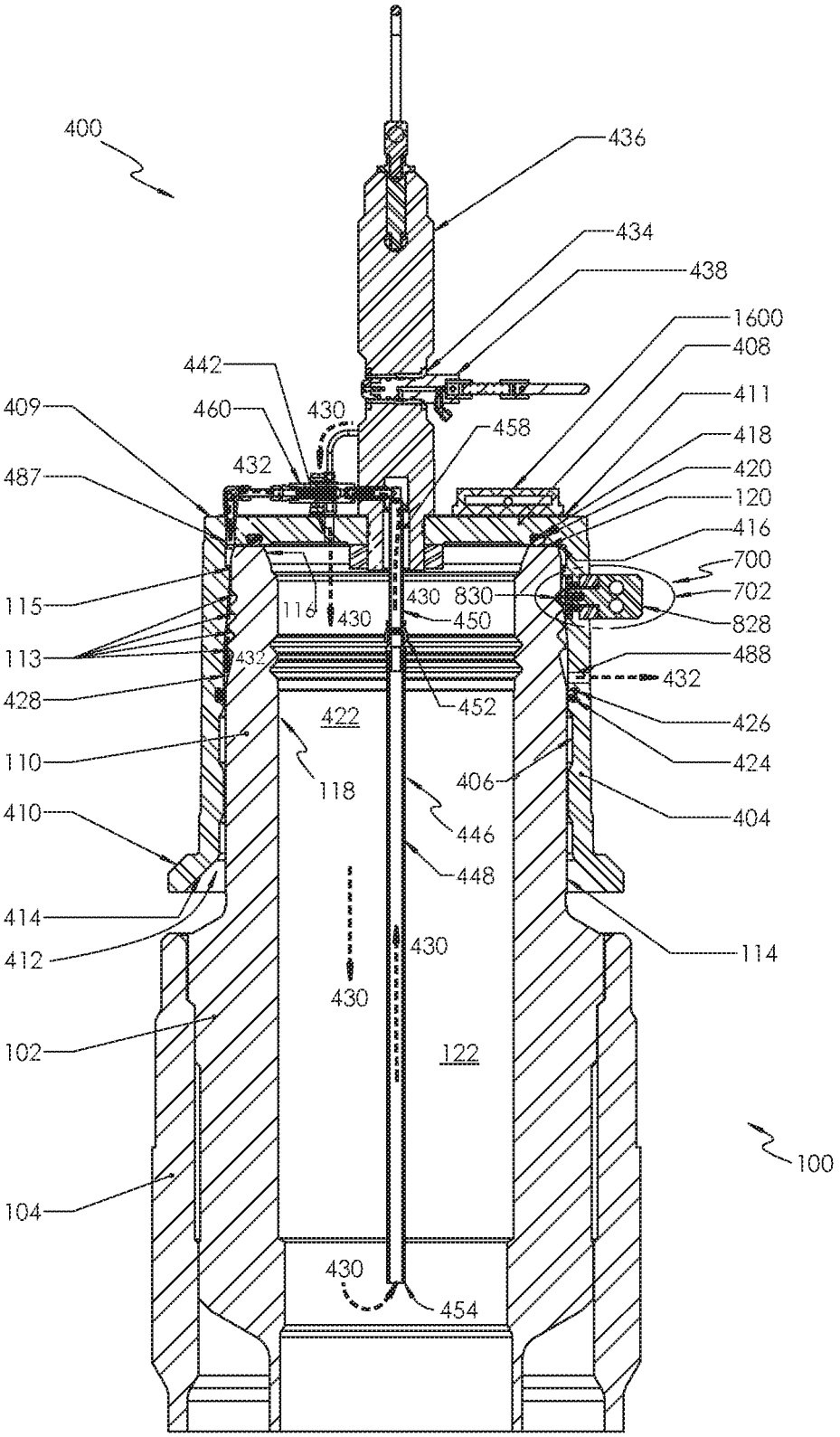
FIG. 5 illustrates a cross sectional view of the protective cap assembly of FIG. 4 disposed on and coupled to a mandrel of an example subsea wellhead assembly, according to one or more embodiments of the disclosure.
Figure 6:
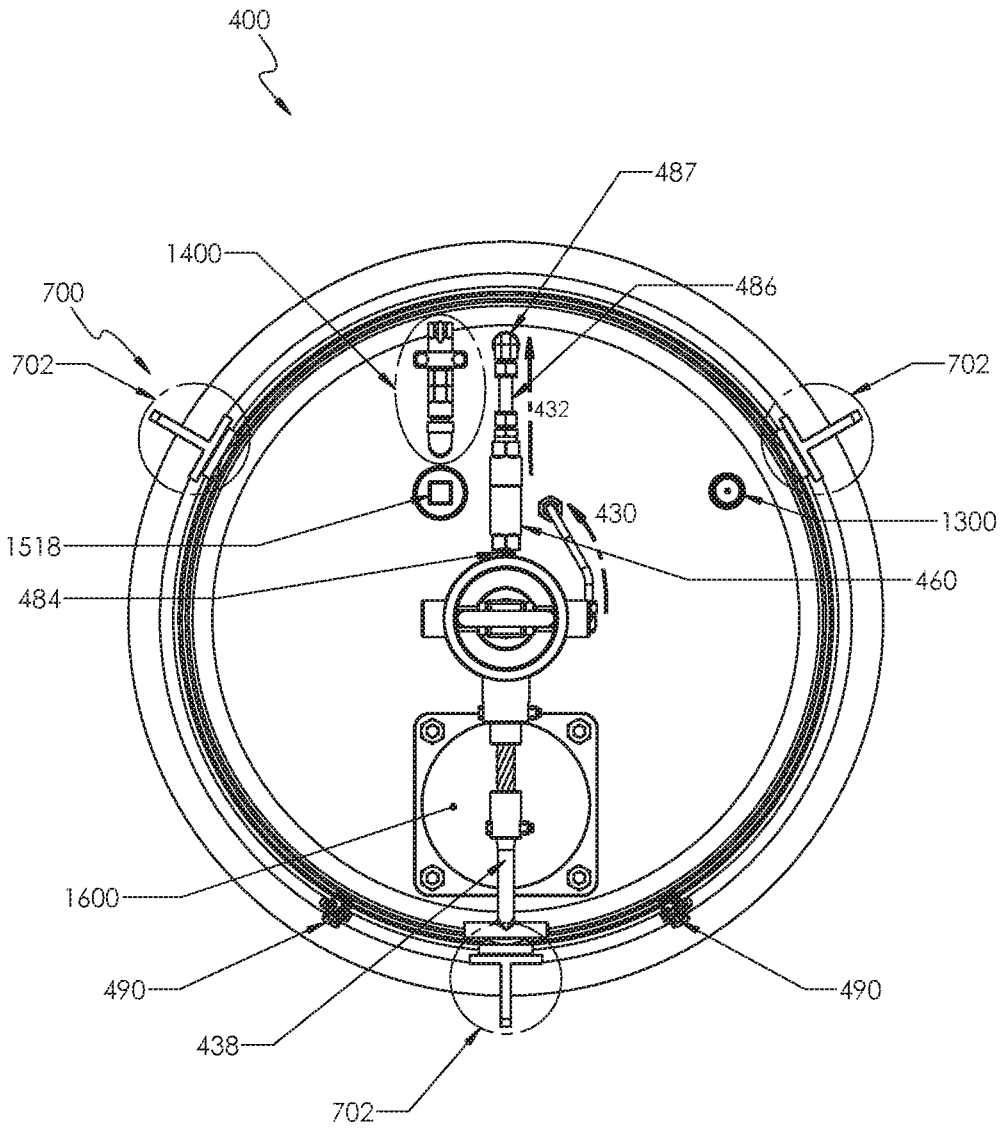
FIG. 6 illustrates a top view of the protective cap assembly of FIG. 4, according to one or more embodiments of the disclosure.
Figure 7:
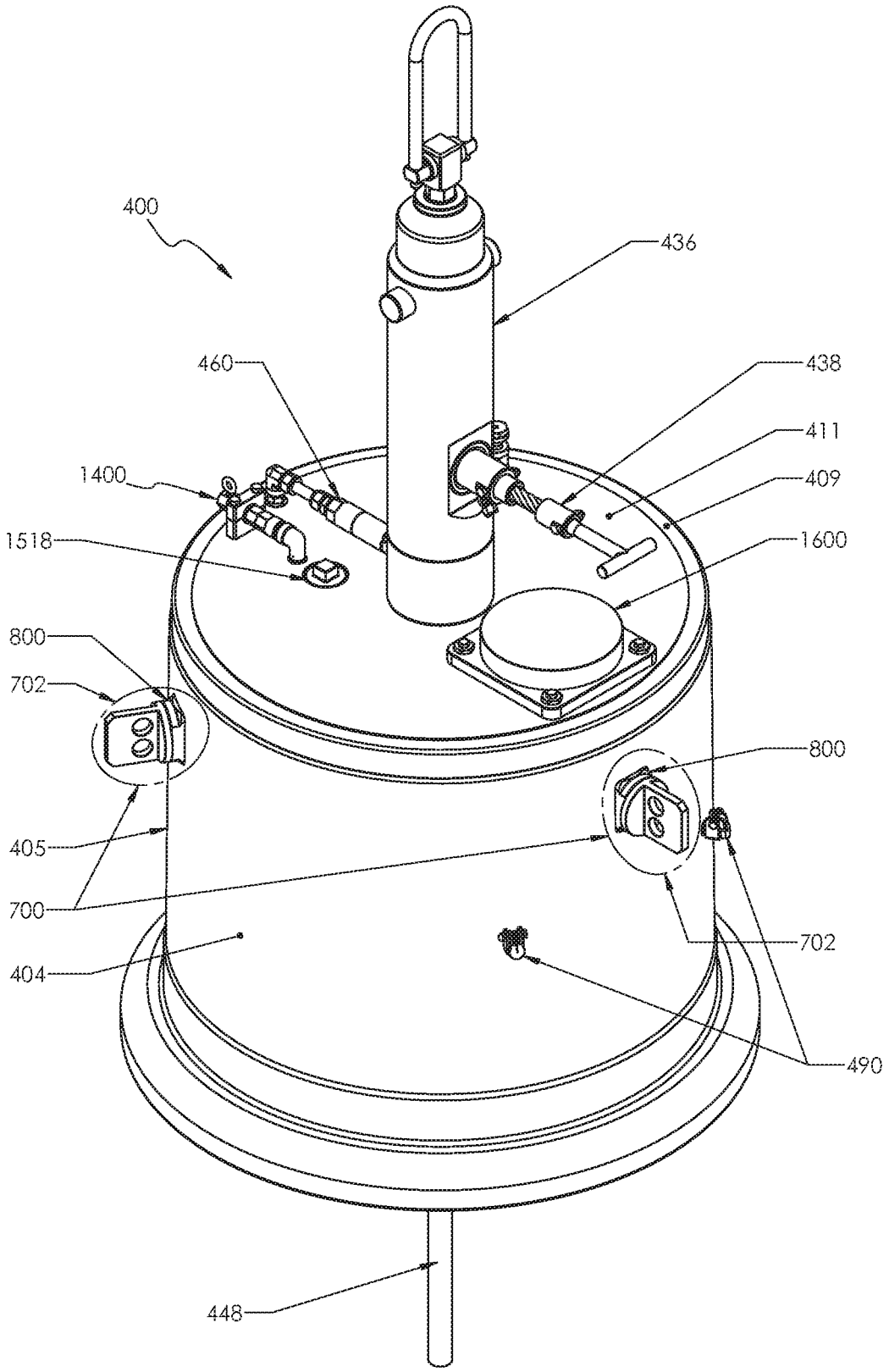
FIG. 7 illustrates an isometric view of the protective cap assembly of FIG. 4 including an example locking system, according to one or more embodiments of the disclosure.

Turning now to the Figures, FIGS. 4-7 illustrate various views of an example protective cap assembly 400, according to one or more embodiments of the disclosure. In particular, FIG. 4 illustrates a cross sectional view of the protective cap assembly 400, according to one or more embodiments of the disclosure. FIG. 5 illustrates a cross sectional view of the protective cap assembly 400 of FIG. 4 disposed on and coupled to an example subsea wellhead assembly, according to one or more embodiments of the disclosure. The example subsea wellhead assembly illustrated in FIG. 5 may be similar in some respects to the subsea wellhead assembly 100 described above and thus may be best understood with reference to FIG. 1, where like numerals designate like components and will not be described again in detail. FIG. 6 illustrates a top view of the protective cap assembly 400 of FIG. 4, according to one or more embodiments of the disclosure. FIG. 7 illustrates an isometric view of the protective cap assembly 400 of FIG. 4, according to one or more embodiments of the disclosure.

The protective cap assembly 400 may be utilized to protect the mandrel of a subsea wellhead, a subsea tubing head spool, or a subsea tree during the temporary abandonment of a subsea hydrocarbon well (not shown). A similar protective cap assembly may be used to protect a subsea tree mandrel for long-term installation. As will be discussed in more detail below, the protective cap assembly 400 may be utilized to protect portions of the mandrel from corrosion and/or deposits forming thereupon. In addition, the protective cap assembly 400 may be utilized to protect portions of the mandrel from contact with external objects and to prevent external objects or debris from entering the bore 122 of the subsea hydrocarbon well.

As shown most clearly in FIG. 5, the protective cap assembly 400 may include a protective cap body 402 configured to be disposed on a mandrel 110 of the subsea wellhead assembly 100. As illustrated, the mandrel 110 may include a plurality of circumferential grooves (four shown 112) formed in an main outer circumferential surface 114 of the mandrel 110 that define one or more angled shoulder surfaces (four shown 113) to provide a connection means to a wellhead connector (not shown). The wellhead connector may interconnect, for example, a blowout preventer (BOP) device (not shown) or production system (not shown) with the mandrel 110. The mandrel 110 may also include one of more conical sealing surfaces 116 extending from an inner circumferential surface 118 to a top face 120 of the mandrel 110. The conical sealing surface 116 may be configured to interface with a metal ring gasket (not shown) of the wellhead connector to seal liquids and gases at varying pressures. The inner circumferential surface 118 of the mandrel may further define a bore 122 through which fluids may enter and exit the wellbore.

The protective cap body 402 may include a cylindrical sidewall 404 having an inner cylindrical surface 406 configured to be disposed about the upper outer circumferential surface 115, the circumferential grooves 112, and the main outer circumferential surface 114 of the mandrel 110, with the inner cylindrical surface 406 having varying inner diameters and tapered surfaces to receive the varying exterior features of the mandrel 110. To that end, an upper end portion of the cylindrical sidewall 404 may be coupled to or integral with a top plate 408 of the protective cap body 402, the top plate 408 being capable of containing low pressures (e.g., about ½ psi to about 100 psi), and a lower end portion of the cylindrical sidewall 404 may be coupled to or integral with a conically shaped wall 410 of the protective cap body 402. The conically shaped wall 410 may define an opening 412 through which the mandrel may be received, and the conically shaped wall may further form a funnel 414 extending from the opening 412 to the inner cylindrical surface 406 to assist with the alignment of the protective cap assembly 400 on the mandrel 110.

The cylindrical sidewall 404, the top plate 408, and the conically shaped wall 410 of the protective cap body 402 may be fabricated individually and assembled together, or may be manufactured as a single unit. In one or more embodiments, one or more of the cylindrical sidewall 404, the top plate 408, and the conically shaped wall 410 may be constructed of a metallic material. In other embodiments, one or more of the cylindrical sidewall 404, the top plate 408, and the conically shaped wall 410 may be constructed of a nonmetallic material. Accordingly, the protective cap assembly 400 may be constructed of a metallic material, a nonmetallic material, or a combination of both. For example, in one or more embodiments, the protective cap body 402 may be constructed of a plastic material as a single molded part.

In embodiments in which one or more of the cylindrical sidewall 404, the top plate 408, and the conically shaped wall 410 may be constructed of a plastic material, the plastic material utilized may include, but is not limited to, polyethylene, polypropylene, acetal, polyurethane, nylon, combinations thereof, or modified variants compounded with fibers such as fiberglass or carbon fiber. In embodiments in which one or more of the cylindrical sidewall 404, the top plate 408, and the conically shaped wall 410 may be constructed of a nonmetallic material other than conventional plastics, the nonmetallic material utilized may include, but is not limited to, fiber-reinforced elastomeric composite materials, fiber-reinforced plastic composite materials, or combinations thereof. In embodiments in which one or more of the cylindrical sidewall 404, the top plate 408, and the conically shaped wall 410 may be constructed of a metallic material, the metallic material utilized may include, but is not limited to, steel, stainless steel, aluminum, titanium, copper alloys, nickel alloys, or combinations thereof.

As shown in FIGS. 4 and 5, an inner surface 416 of the top plate 408 may define an annular groove 418 configured to seat therein a primary seal 420 of the protective cap assembly 400. The primary seal 420 may be disposed in the annular groove 418 such that the primary seal 420 engages the top face 120 of the mandrel 110 in a sealing relationship therewith when disposed thereon. In another embodiment, the primary seal 420 may be coupled to the inner surface 416 of the protective cap body 402 with bonded adhesives or alternatively with a plurality of mechanical fasteners (e.g. screws or bolts). In another embodiment, the primary seal 420 may be disposed in the annular groove 418 such that the primary seal 420 engages the conical sealing surface 116 of the mandrel 110 in a sealing relationship therewith. In another embodiment, the inner circumferential surface 406 of the cylindrical sidewall 404 may define an annular groove 418, with the primary seal 420 disposed in the annular groove 418 to contact the upper outer circumferential surface 115 at an upper portion of the mandrel 110.

The primary seal 420 may be constructed of an elastomeric material. For example, the primary seal 420 may be an O-ring. In other embodiments, the primary seal 420 may be a lip seal or a u-cup seal. Those of ordinary skill in the art will appreciate that other seal types may be utilized as the primary seal 420 without departing from the scope of this disclosure. As arranged in FIG. 5, the primary seal 420, the top plate 408, the top face 120, and the inner circumferential surface 118 of the mandrel 110 form at least in part a primary chamber 422 within the bore 122 of the mandrel 110 and inwards of the primary seal 420. As configured, the conical sealing surface 116 and inner cylindrical surface 118 may be isolated from the corrosive seawater and other damaging elements of the subsea environment.

As shown in FIGS. 4 and 5, the inner cylindrical surface 406 of the cylindrical sidewall 404 may define an annular groove 424 configured to seat therein a secondary seal 426 of the protective cap assembly 400. The secondary seal 426 may be disposed in the annular groove 424 such that the secondary seal 426 engages the main outer circumferential surface 114 of the mandrel 110 in a sealing relationship therewith below the plurality of circumferential grooves 112 of the mandrel 110. Similar to the primary seal 420, the secondary seal 426 may be constructed of an elastomeric material. For example, the secondary seal 426 may be an O-ring. In other embodiments, the secondary seal 426 may be a lip seal or a u-cup seal. Those of ordinary skill in the art will appreciate that other seal types may be utilized as the secondary seal 426 without departing from the scope of this disclosure. The primary seal 420 and the secondary seal 426 define respective upper and lower ends of a secondary chamber 428 formed at least in part between the main outer circumferential surface 114 of the mandrel 110 and the inner cylindrical surface 406 of the cylindrical sidewall 404. As configured, the circumferential grooves 112 of the mandrel 110 may be isolated from the corrosive seawater and other damaging elements of the subsea environment.

The protective cap assembly 400 may include a corrosion inhibitor fluid injection assembly fluidly coupled with the primary chamber 422 via a primary fluid flowpath (indicated by dashed line 430) and configured to provide a corrosion inhibitor fluid in contact with the conical sealing surface 116 and inner cylindrical surface 118 of the mandrel 110 to prevent or substantially reduce corrosion thereof. In one or more embodiments, the corrosion inhibitor fluid injection assembly may be fluidly coupled with the secondary chamber 428 via the primary fluid flowpath 430 and a secondary fluid flowpath (indicated by dashed line 432). Accordingly, the corrosion inhibitor fluid injection assembly may be further configured to provide a corrosion inhibitor fluid in contact with the circumferential grooves 112 of the mandrel 110 to prevent or substantially reduce corrosion thereof.

In one or more embodiments, the corrosion inhibitor fluid injection assembly may include a hot stab receptacle 434 mounted to a central post 436 of the protective cap assembly 400, the top post 436 being coupled to and extending upward from the top plate 408 of the protective cap body 402. The hot stab receptacle 434 may be configured to receive a male hot stab 438 connected via hoses and fittings (not shown) to one or more pumps (not shown) controlled by a remotely operated vehicle (ROV) (not shown). The ROV may include a storage tank or other source of corrosion inhibitor fluid. In other embodiments, the ROV may be fluidly coupled to a source of corrosion inhibitor fluid.

The hot stab receptacle 434 may be fluidly coupled with the primary chamber 422 via the primary fluid flowpath 430 defined in part by a conduit 440, a primary inlet port 442 defined by and extending through the top plate 408, and a check valve 444 fluidly coupled to the conduit 440 and the primary inlet port 442. The check valve 444 may be a one-way check valve configured to selectively permit the injection of the corrosion inhibitor fluid into the primary chamber 422 and prevent backflow. A lightweight corrosion inhibitor fluid may be injected via the hot stab receptacle 434 and primary fluid flowpath 430 into the primary chamber 422 within the bore 122 of the mandrel 110, thereby displacing any seawater in the bore downwards, with excess fluid being vented from the primary chamber 422 via a remainder of the primary fluid flowpath 430 defined by a vent pipe assembly 446 of the protective cap assembly 400.

In one or more embodiments, the vent pipe assembly 446 may include a vent pipe extension 448 coupled to a main vent pipe 450. The vent pipe extension 448 may be constructed similarly to the main vent pipe 450, or may differ, for example, in material. Further, it will be appreciated that the vent pipe extension 448 may be constructed in the form of a hose, tubing, or other like conduit. The vent pipe extension 448 may be coupled to the main vent pipe 450 via a pipe fitting 452, as shown in FIGS. 4 and 5. As configured in FIG. 5, the excess fluid displaced downward in the bore 122 to a bottom opening 454 of the vent pipe extension 448 may be vented from the primary chamber 422 via the vent pipe assembly 446 of the protective cap assembly 400. In one or more embodiments, the bottom opening 454 of the vent pipe extension 448 may be disposed between about 6 inches to about 72 inches below the top face 120 of the mandrel 110; however, the length of the vent pipe assembly 446 and thus the column of corrosion inhibitor fluid in the bore 122 may be modified as desired by changing the length of the vent pipe assembly 446.

As shown most clearly in FIGS. 4 and 5, the upper portion 456 of the main vent pipe 450 of the vent pipe assembly 446 may be disposed in a cavity 458 formed in the top post 436 and may be coupled to a check valve 460 via a conduit 484, and further connected to a secondary fluid flowpath 432 and a secondary chamber 428 via another conduit 486. In another embodiment, the upper portion 456 of the main vent pipe 450 may be connected to a port (not shown) in the top plate 408 of the protective cap body. Those of ordinary skill in the art will appreciate that there are many ways to configure a fluid port to pass fluid through a protective cap body without departing from the scope of the present disclosure. In another embodiment, the upper portion 456 of the main vent pipe 450 of the vent pipe assembly 446 may be disposed in the cavity 458 formed in the top post 436 and may be fluidly coupled directly to the subsea environment via the conduit 484 and the check valve 460. In one or more embodiments, the check valve 460 may be a one-way check valve with a low opening pressure (e.g., about ½ psi to about 25 psi) to create a barrier between the primary chamber 422 and the external subsea environment. Those of ordinary skill in the art will appreciate that the opening pressure of the check valve 460 may be low, as any backpressure under the top plate 408 during the injection of the corrosion inhibitor injection fluid may lead to very high and undesirable lifting forces. In another embodiment, the check valve 460 may be disposed within the primary chamber 422 and coupled to either of the main vent pipe 450 or the vent pipe extension 448.

As shown in FIGS. 4-7, the secondary fluid flowpath 432 may be defined, in part, by another conduit 486 extending from the check valve 460 to a secondary inlet port 487 defined by and extending through the top plate 408 of the protective cap body 402 and fluidly coupling the secondary chamber 428 and the primary chamber 422. Following the secondary fluid flowpath 432, the fluid vented from the primary chamber 422 via the vent pipe assembly 446 and the conduit 484 may flow through the check valve 460, the conduit 486, and the secondary inlet port 487, and into the secondary chamber 428. In another embodiment, an ROV-operated valve (not shown) may be disposed in the secondary fluid flowpath 432 between the check valve 460 and the secondary inlet port 487, such that the ROV-operated valve may direct fluid from the check valve 460 to the secondary inlet port 487, or alternatively may direct fluid directly to the subsea environment, depending on the valve position as set by the ROV. As configured in the present disclosure, the secondary inlet port 487 provides the injection point for the corrosion inhibitor fluid to enter the secondary chamber 428. As shown in FIGS. 4 and 5, the cylindrical sidewall 404 may define one or more secondary outlet ports (one shown 488) at the lower end of the secondary chamber 428, where the secondary outlet ports 488 may serve as the remainder of the secondary fluid flowpath 432 to allow excess fluid to be vented from the secondary chamber 428 to the external subsea environment. The secondary outlet ports 488 may include one or more check valves (two shown 490) as shown in FIGS. 6 and 7 to selectively prevent the corrosion inhibitor fluid from exiting the secondary chamber 428. In another embodiment, the secondary outlet ports 488 may include a screen fitting (not shown). In another embodiment as shown in FIGS. 4 and 5, the secondary outlet ports 488 may be unobstructed.

Figure 8:
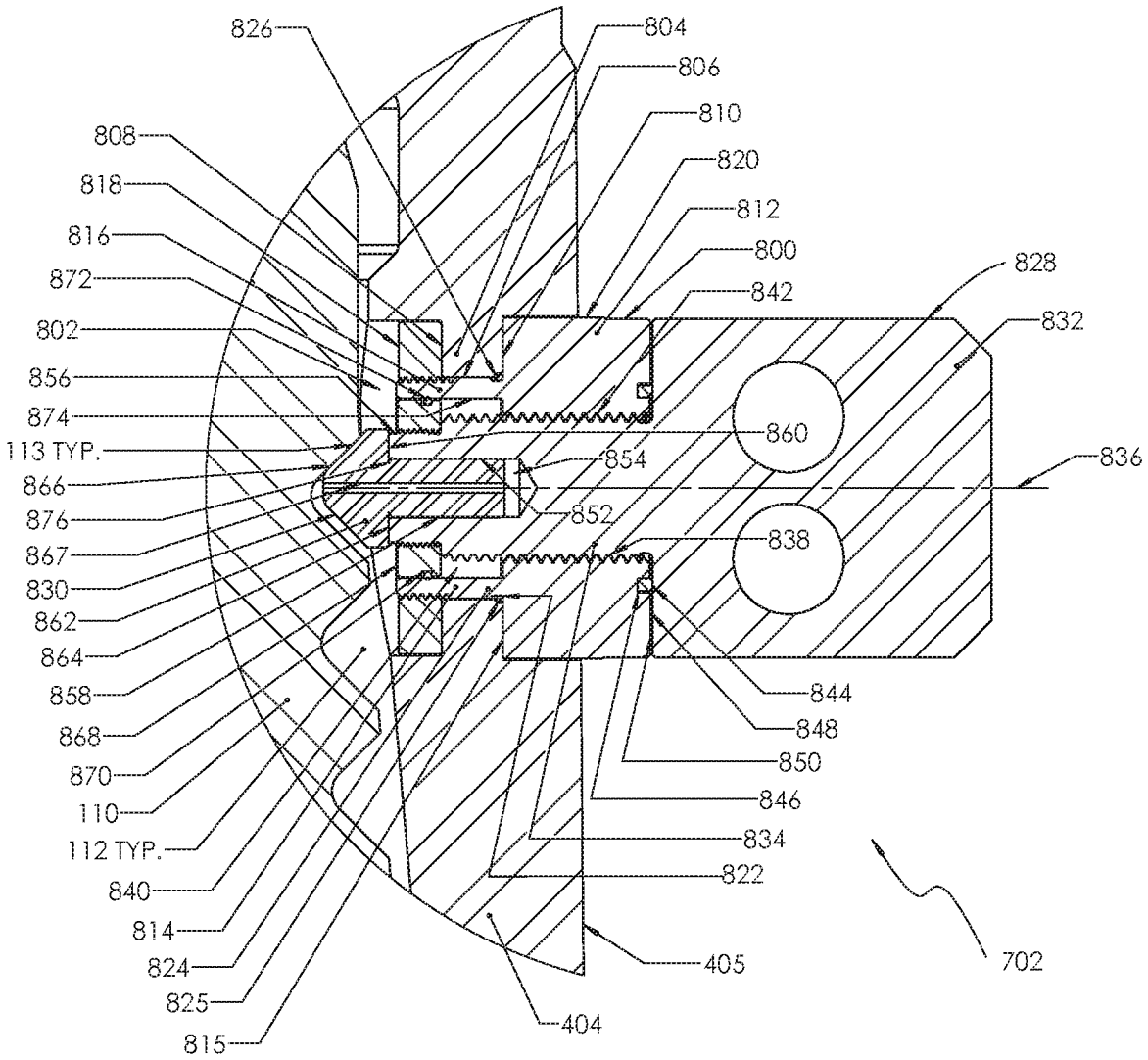
FIG. 8 illustrates an enlarged cross sectional view of an example locking assembly of the locking system of FIG. 7, according to one or more embodiments of the disclosure.

Turning now to FIG. 8 with continued reference to FIGS. 4-7, FIG. 8 illustrates an enlarged cross sectional view of an example locking assembly 702 of the locking system 700 coupled to the protective cap body 402, according to one or more embodiments of the disclosure. As shown most clearly in FIGS. 6 and 7, the locking system 700 may include a plurality of locking assemblies 702 disposed circumferentially about the protective cap body 402 and circumferentially spaced from one another. The locking system 700 may be an active locking system configured to engage and disengage with a mandrel 110, hub 210, or dual hub 310 of a subsea wellhead assembly, a subsea tubing head spool, a subsea tree, subsea pipeline connection, or similar subsea equipment via an ROV. In other embodiments, the locking assembly 702 may be utilized with other wellhead accessory products having a body including a sidewall similar to cylindrical sidewall 402 to be installed to a mandrel 110, hub 210 or dual hub 310 that may call for a suitable locking system, such as a guide funnel (not shown) or a wear bushing (not shown).

The locking system 700 of FIGS. 4-8 may be further configured to couple the protective cap body 402 with and maintain a sealing relationship with the mandrel 110 to allow a corrosion inhibitor fluid to be injected into the protective cap assembly 400 to prevent corrosion and/or the formation of deposits on the mandrel 110. As shown most clearly in FIGS. 6 and 7, the locking system 700 may include three locking assemblies 702 spaced equidistantly from one another; however, the protective cap assemblies of the present disclosure are not limited thereto and may include in other embodiments, one locking assembly, two locking assemblies, or four or more locking assemblies. The locking assembly 702 may further include an actuator 828 integral with or operatively coupled to a locking pin 830 and configured to selectively engage and disengage the locking pin 830 from the angled shoulder surface 113 of the mandrel 110. As provided herein and as will be understood from the disclosure below, each locking assembly 702 may be rated for high installation torque, resistant to jamming, resistant to overloading, with low risk of damage to the locking assembly and the subsea equipment mandrel or hub, and rated for high torque during removal.

As most clearly seen in FIG. 8, each locking assembly 702 may include a locking body 800 configured to be disposed in a locking assembly receptacle 802 defined by and extending through the cylindrical sidewall 404 of the protective cap body 402. As disposed on the subsea wellhead assembly 100, the protective cap assembly 400 is configured such that the locking assembly receptacle 802 is generally aligned with an angled shoulder surface 113 of the mandrel 110. The cylindrical sidewall 404 may further define a shoulder 804 reducing a cross section of the locking assembly receptacle 802. As configured, the shoulder 804 may have a shoulder interior surface 806 extending between an interior face 808 and an exterior face 810 thereof.

The locking body 800 may include a main locking body portion 812 and a secondary locking body portion 814 extending from the main locking body portion 812, further comprising a main locking body interior surface 815. The locking body 800 may be configured to be disposed in the locking assembly receptacle 802 such that the main locking body interior surface 815 may seat against the exterior face 810 of the shoulder 804 and the secondary locking body portion 814 may extend along and past the interior face 808 and further into the locking assembly receptacle 802. An end portion 816 of the secondary locking body portion 814 distal the main locking body portion 812 may be coupled to a locking collar 818 or nut seated against the interior face 808 of the shoulder 804. As shown in FIG. 8, the end portion 816 of the secondary locking body portion 814 may include external threads and thereby may be threadingly coupled to the locking collar 818, such that the locking body 800 may be securely coupled to the cylindrical sidewall 404.

As most clearly shown in FIG. 7, an outer cylindrical surface 405 of the cylindrical sidewall 404 defines the exterior portion of the receptacle 802 for each locking assembly 702 predominantly in the shape of a rectangle, and an outer surface 820 of the main locking body portion 812 of each locking body 800 is defined predominantly in the shape of a rectangle. As such, the main locking body portion 812 of each locking body 800 may be engaged and coupled to the rectangular portion of the receptacle 802 and configured to prevent rotation thereof in the locking assembly receptacle 802. In one or more embodiments, the shoulder interior surface 806 of the cylindrical sidewall 404 may be annular. Accordingly, in such embodiments, the secondary locking body portion 814 may be annular and the end portion 816 thereof may include external threads, such that the locking collar 818, or retaining nut in one or more embodiments, may be threadingly coupled thereto to secure the locking body 800 to the cylindrical sidewall 404. In another embodiment, the end portion 816 of the secondary locking body portion 814 may include a plurality of threaded openings configured to receive a plurality of mechanical fasteners (e.g., bolts) to retain a flange (not shown) to secure the locking body 800 to the cylindrical sidewall 404.

As most clearly seen in FIG. 8, the secondary locking body portion 814 may define an annular groove 822. In one or more embodiments, the annular groove 822 may be located at an end portion 824 thereof proximal the main locking body portion 812. The shoulder interior surface 806 of the cylindrical sidewall may have a tapered shoulder surface 825 or pocket (not shown) at the junction with the exterior face 810. An annular seal 826 (e.g., an elastomeric seal such as an O-ring) may be seated within the annular groove 822 and configured to engage the shoulder interior surface 806, the exterior face 810, or the tapered shoulder surface 825 or pocket (not shown) of the cylindrical sidewall 404 in a sealing relationship therewith. In another embodiment, the shoulder interior surface 806 may define an annular groove (not shown) configured to seat therein an annular seal (not shown) such that the annular seal engages the secondary locking body portion 814 in a sealing relationship therewith. In another alternative embodiment, the annular seal 826 may be installed to an annular groove (not shown) at the interface where the main locking body interior surface 815 is seated against the exterior face 810 of the shoulder 804.

The actuator 828 of the locking assembly 702 may include an ROV interface member 832 and a main actuator portion 834 extending from the ROV interface member 832 along a longitudinal axis 836 of the actuator 828. An inner surface 838 of the main locking body portion 812 may define a main locking body portion opening 840 configured to receive therethrough the main actuator portion 834. The main actuator portion 834 may be coupled to the inner surface 838 of the main locking body portion 812. As shown in FIG. 8, an outer surface 842 of the main actuator portion 834 may have external threads configured to couple with internal threads of the inner surface 838 of the main locking body portion 812. Thus, as coupled, the main actuator portion 834 may be threaded toward the angled shoulder surface 113 or away from the angled shoulder surface 113 via the rotation of the ROV interface member 832 about the longitudinal axis 836 of the actuator 828.

The main actuator portion 834 and ROV interface member 832 may be configured to be rotated about the longitudinal axis 836 via the ROV (not shown). Accordingly, in one or more embodiments, the ROV interface member 832 may be or include an ROV paddle handle as shown in FIG. 8. In another embodiment, the ROV interface member 832 may be or include a T-handle (not shown). It will be appreciated that the ROV interface member 832 is not limited to the above embodiments, and accordingly, the ROV interface member 832 may be or include any suitable shape for interfacing with an ROV manipulator arm or ROV tool configured to actuate the ROV interface member 832.

To prevent jamming of the locking assembly 802 during rotation of the ROV interface member 832 via the ROV, an annular component 844, illustrated as a ring, may be disposed in an annular groove 846 defined by an exterior surface 848 of the main locking body portion 812. In one or more embodiments, the annular component 844 may be a nonmetallic ring. The nonmetallic ring may be constructed of a plastic material, the plastic material utilized may include, but is not limited to, polyethylene, polypropylene, acetal, polyurethane, nylon, or modified variants compounded with fibers such as fiberglass, carbon fiber, or polytetrafluoroethylene (e.g. P.T.F.E.). In other embodiments the nonmetallic ring may be constructed of a nonmetallic material other than plastic, the nonmetallic material utilized may include, but is not limited to, fiber-reinforced elastomeric composite materials, fiber-reinforced plastic composite materials, or combinations thereof. The annular component 844 may protrude from the annular groove 846 and may be configured to prevent contact between an interior surface 850 of the ROV interface member 832 and the exterior surface 848 of the main locking body portion 812 at the maximum ROV torque. In another embodiment, the annular component 844 may be disposed in an annular groove (not shown) defined by the interior surface 850 of the ROV interface member 832.

Those of ordinary skill in the art will appreciate that other methods may be used to engage and disengage the main actuator portion 834 from the angled shoulder surface 113 of a mandrel 110, hub 210, or dual hub 310. In another embodiment, a main actuator portion 834 may be rotated via the ROV interface member 832, with a pin or bolt (not shown) installed to the main actuator portion 834 and engaged to a helical milled slot (not shown) in the locking body 800 to produce radial movement in response to the rotational input. In another alternative embodiment, the main actuator portion 834 may be coupled to a hydraulic piston and seal (not shown) which is fluidly coupled in turn to a hydraulic fluid source to produce radial movement in response to hydraulic fluid supplied to the hydraulic piston, and by this method to selectively engage or disengage the locking pin 830 from the angled shoulder surface 113.

An inner surface 852 of the main actuator portion 834 may define an actuator locking pin bore 854 at an end portion 856 thereof distal the ROV interface member 832. The actuator locking pin bore 854 may be configured to receive a locking pin shaft 858 of a discrete locking pin 830. In one or more embodiments, the locking pin shaft 858 may be press fit within the actuator locking pin bore 854, threaded, or otherwise coupled therewith such that an exterior face 860 of a locking pin head 862 of the locking pin 830 may be seated against an end face 864 of the main actuator portion 834. In another embodiment, the locking pin 830 may be integral with the main actuator portion 834 such that the locking pin 830 and the main actuator portion 834 are constructed or formed as a monolithic component. An exterior face 866 of the locking pin head 862 may be shaped to generally conform to the angled shoulder surface 113 of the mandrel 110, hub 210, or dual hub 310. In one embodiment the locking assembly 702 is configured such that the interior surface 850 of the ROV interface member 832 contacts the annular component 844 and limits the travel of the locking pin 830 such that the locking pin 830 cannot over-travel relative to the angled shoulder surface 113 of the mandrel or hub at maximum radial travel of the actuator 828. In another embodiment the locking assembly 702 is configured such that the interior surface 850 of the ROV interface member 832 directly contacts the exterior surface 848 of the main locking body portion 812 and limits the travel of the locking pin 830 such that the locking pin 830 cannot over-travel relative to the angled shoulder surface 113 of the mandrel or hub at maximum radial travel of the actuator 828. Such a design enables the angled shoulder surface 113 to avoid risk of damage from contact with the locking assembly 702.

The end portion 856 of the main actuator portion 834 may further be coupled to a locking collar 868 or nut to prevent unintended dis-assembly of the locking assembly 702 by the ROV. In addition, the locking collar 868 may also define an annular groove 870 configured to seat therein an annular seal 872 (e.g., an O-ring) which engages an inner surface 874 of the secondary locking body portion 814 at the end portion 816 thereof distal the main locking body portion 812. As configured within the main actuator portion 834, the locking pin 830 may further define a vent channel 867 extending through the locking pin shaft 858 and locking pin head 862 to fluidly couple the actuator locking pin bore 854 to the external subsea environment to equalize pressure within the locking pin bore 854 to the subsea environment. In an alternative embodiment, the main actuator portion 834 may define a vent channel (not shown) extending through the main actuator portion 834 to the external subsea environment and configured to fluidly couple the actuator locking pin bore 854 to the subsea environment.

In one or more embodiments, the locking pin 830 may be constructed of a metallic material or nonmetallic material. In one embodiment the locking pin 830 may be constructed of a plastic material, the plastic material utilized may include, but is not limited to, polyethylene, polypropylene, acetal, polyurethane, nylon, similar thermoplastics, or modified variants compounded with fibers such as fiberglass, carbon fiber, or polytetrafluoroethylene (e.g. P.T.F.E.). In other embodiments the locking pin 830 may be constructed of a nonmetallic material other than plastic, the nonmetallic material utilized may include, but is not limited to, fiber-reinforced elastomeric composite materials, fiber-reinforced plastic composite materials, or combinations thereof. In other embodiments the locking pin 830 may be constructed of a metallic material, the metallic material utilized may include steel, stainless steel, aluminum, titanium, copper alloys, nickel alloys, or combinations thereof. The locking pin 830 may further be configured to fail in a controlled manner at a specified location and a predictable maximum load. To that end, a groove 876 may be formed in the locking pin 830 near the junction of the locking pin head 862 and the locking pin shaft 858. The diameter of the groove 876 and size of the vent channel 867, if applicable, may be configured to provide a specific load rating based on the strength of the material of the locking pin 830. In the event of overload, the locking pin 830 may shear in half at the groove 876 at the specified load rating.

Figure 9:
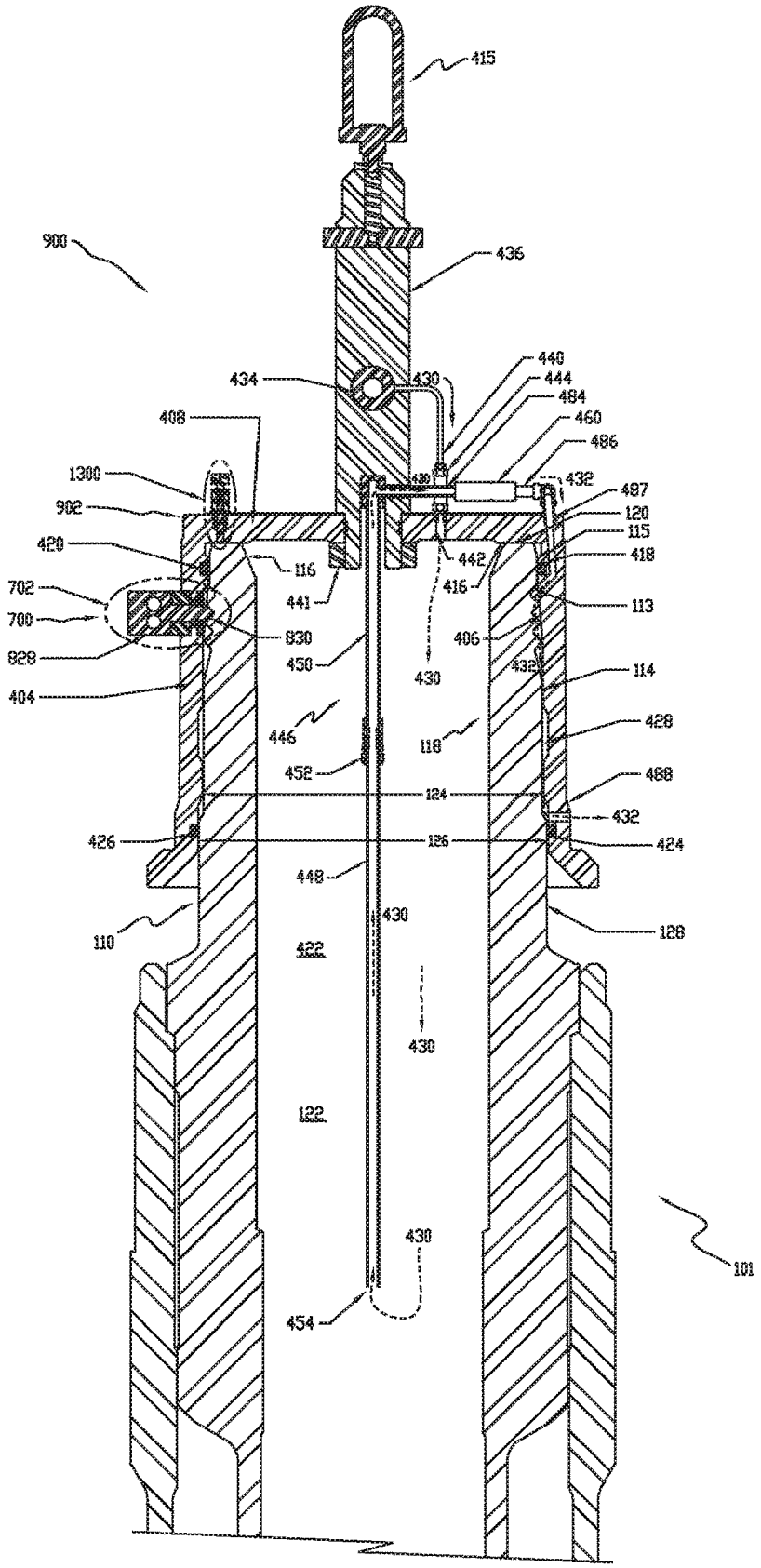
FIG. 9 illustrates a cross sectional view of another example protective cap assembly disposed on and coupled to a subsea wellhead mandrel, according to one or more embodiments of the disclosure.

Referring now to FIG. 9, FIG. 9 illustrates a cross sectional view of another example protective cap assembly 900 disposed on and coupled to a subsea wellhead assembly 101, according to one or more embodiments of the disclosure. The protective cap assembly 900 may be similar in some respects to the protective cap assembly 400 described above and thus may be best understood with reference to FIGS. 4-7 and the description thereof, where like numerals designate like components and will not be described again in detail. Additionally, the subsea well head assembly 101 may be similar in some respects to subsea wellhead assembly 100 described above and thus like numerals may reflect like components.

As illustrated in FIG. 9, the protective cap assembly 900 may include a protective cap body 902 configured to be disposed on a mandrel 110 of the subsea wellhead assembly 101. The protective cap body 902 may include a cylindrical sidewall 404 having an inner cylindrical surface 406 configured to be disposed about the upper outer circumferential surface 115, the circumferential grooves 112, and the main outer circumferential surface 114 of the mandrel 110. The cylindrical sidewall 404 may define an annular groove 418 configured to seat therein a primary seal 420 of the protective cap assembly 900. The primary seal 420 may be disposed in the annular groove 418 such that the primary seal 420 engages the upper outer circumferential surface 115 at the top of the mandrel 110 in a sealing relationship therewith above the plurality of circumferential grooves 112 of the mandrel 110.

In another embodiment, the primary seal 420 may be disposed in the annular groove 418 such that the primary seal 420 engages the main outer circumferential surface 114 of the mandrel 110 in a sealing relationship therewith below the plurality of circumferential grooves 112 of the mandrel 110. Below the plurality of circumferential grooves 112, the main outer circumferential surface 114 of the mandrel 110 may be stepped, such that the outer circumferential surface of the mandrel 110 may have a first diameter 124, and a second diameter 126 corresponding to the stepped outer circumferential surface 128 and arranged below the first diameter. Accordingly, in an embodiment in which the primary seal 420 engages an outer circumferential surface of the mandrel 110 in a sealing relationship therewith below the plurality of circumferential grooves 112, the primary seal 420 may be disposed in the annular groove 418 such that the primary seal 420 sealingly engages the main outer circumferential surface 114 of the mandrel 110 having the first diameter 124, or the stepped outer circumferential surface 128 of the mandrel 110 having the second diameter 126. In all embodiments noted, the primary seal 420, the top plate 408, the top face 120, and the inner circumferential surface 118 of the mandrel 110 form at least in part a primary chamber 422 within the bore 122 of the mandrel 110 and inwards of the primary seal 420.

As shown in FIG. 9, the cylindrical sidewall 404 may further define another annular groove 424 configured to seat therein a secondary seal 426 of the protective cap assembly 900. The secondary seal 426 may be disposed in the annular groove 424 such that the secondary seal 426 engages the main outer circumferential surface 114 or the stepped outer circumferential surface 128 of the mandrel 110 in a sealing relationship therewith below the plurality of circumferential grooves 112. The primary seal 420 and the secondary seal 426 define respective upper and lower ends of a secondary chamber 428 formed at least in part between the main outer circumferential surface 114 of the mandrel 110 and the inner cylindrical surface 406 of the cylindrical sidewall 404. The primary chamber 422 and the secondary chamber 428 may be fluidly coupled with one another via a primary fluid flowpath (indicated by dashed line 430) and a secondary fluid flowpath (indicated by dashed line 432) with a check valve 460 to selectively prevent fluid from exiting the primary chamber 422. The secondary fluid flowpath 432 may be further defined by a secondary inlet port 487 in the protective cap body 902 that provides an injection point for fluid to enter the secondary chamber 428. The cylindrical sidewall 404 may further define one or more secondary outlet ports (one shown 488) for the secondary chamber 428 at the bottom of the secondary chamber 428 and above the secondary seal 426, thereby fluidly coupling the secondary fluid flowpath 432 with the external subsea environment to vent excess fluid to the subsea environment. The secondary outlet port(s) 488 may include a check valve (not shown). In another embodiment, the secondary outlet port(s) 488 may include a screen fitting (not shown). In the embodiment as shown in FIG. 9, the secondary outlet port(s) 488 may be unobstructed.

With reference to FIG. 9, the primary seal 420 and the secondary seal 426 may each be constructed of an elastomeric material. For example, the primary seal 420 and/or the secondary seal 426 may be an O-ring. In other embodiments, the primary seal 420 and/or the secondary seal 426 may be a lip seal or a u-cup seal. Those of ordinary skill in the art will appreciate that other seal types may be utilized as the primary seal 420 and/or the secondary seal 426 without departing from the scope of this disclosure.

The protective cap assembly 900 of FIG. 9 may have an active locking system 700 including one or more locking assemblies 702 configured to engage and disengage with the mandrel 110 of the subsea wellhead assembly 101 via an ROV. Each locking assembly 702 may be further configured to couple the protective cap body 902 with and maintain a sealing relationship with the mandrel 110 to allow a corrosion inhibitor fluid to be injected into the protective cap assembly 900 to prevent corrosion and/or the formation of deposits on the mandrel 110. As shown in FIG. 9, the locking assembly 702 may include an actuator 828 integral with or operatively coupled to a locking pin 830 and configured to selectively engage and disengage the locking pin 830 from the angled shoulder surface 113 of the mandrel 110.

Figure 10:
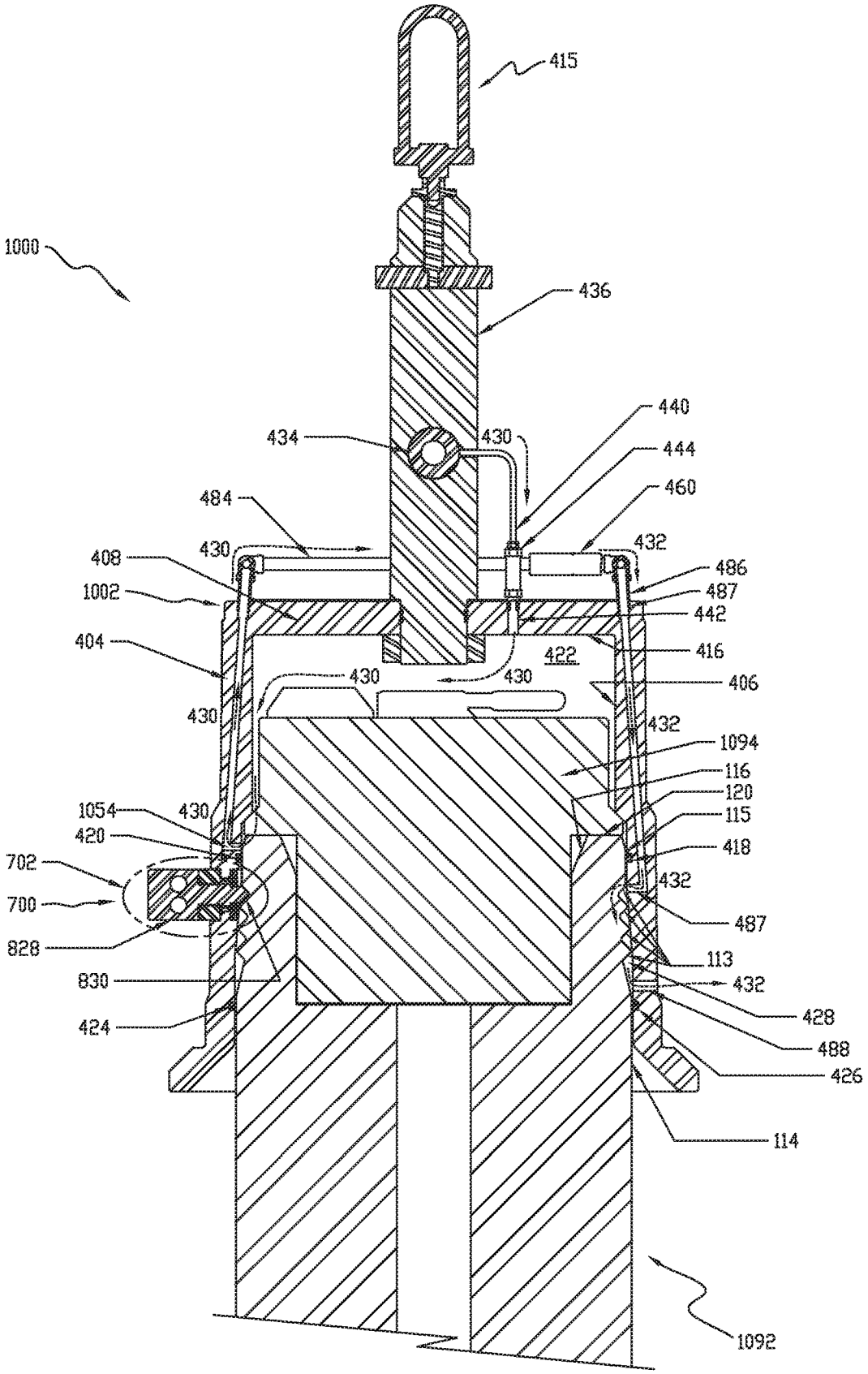
FIG. 10 illustrates a cross sectional view of another example protective cap assembly disposed on and coupled to a subsea tree mandrel, according to one or more embodiments of the disclosure.

Referring now to FIG. 10, FIG. 10 illustrates a cross sectional view of another example protective cap assembly 1000 disposed on and coupled to a subsea tree mandrel 1092, according to one or more embodiments of the disclosure. The protective cap assembly 1000 may be similar in some respects to the protective cap assembly 400 described above and thus may be best understood with reference to FIGS. 4-7 and the description thereof, where like numerals designate like components and will not be described again in detail. As shown in FIG. 10, the subsea tree may include a subsea tree mandrel 1092 with an internal tree cap 1094 coupled to the subsea tree mandrel 1092, such that the internal tree cap 1094 protrudes above the top face 120 of the subsea tree mandrel 1092. The protective cap assembly 1000 may be configured to be disposed over the internal tree cap 1094 and coupled to the subsea tree mandrel 1092.

As illustrated in FIG. 10, the protective cap assembly 1000 may include a protective cap body 1002 configured to be disposed on a subsea tree including a subsea tree mandrel 1092 and an internal tree cap 1094. The protective cap body 1002 may include a cylindrical sidewall 404 having an inner cylindrical surface 406 configured to be disposed about the upper outer circumferential surface 115, the circumferential grooves 112, and the main outer circumferential surface 114 of the subsea tree mandrel 1092. The cylindrical sidewall 404 may define an annular groove 418 configured to seat therein a primary seal 420 of the protective cap assembly 1000. The primary seal 420 may be disposed in the annular groove 418 such that the primary seal 420 engages the upper outer circumferential surface 115 of the subsea tree mandrel 1092 in a sealing relationship therewith above the plurality of circumferential grooves 112 of the subsea tree mandrel 1092. The primary seal 420, the top plate 408, the cylindrical sidewall 404, and the subsea tree mandrel 1092 form at least in part a primary chamber 422 located predominantly above the subsea tree mandrel 1092 and inwards of the primary seal 420. As configured, the conical sealing surface 116 may be isolated from the corrosive seawater and other damaging elements of the subsea environment.

The cylindrical sidewall 404 may further define another annular groove 424 configured to seat therein a secondary seal 426 of the protective cap assembly 1000. The secondary seal 426 may be disposed in the annular groove 424 such that the secondary seal 426 engages the main outer circumferential surface 114 of the subsea tree mandrel 1092 in a sealing relationship therewith below the plurality of circumferential grooves 112. The primary seal 420 and the secondary seal 426 define respective upper and lower ends of a secondary chamber 428 formed at least in part by the main outer circumferential surface 114 of the subsea tree mandrel 1092 and the inner circumferential surface 406 of the cylindrical sidewall 404. As configured, the circumferential grooves 112 of the subsea tree mandrel 1092 may be isolated from the seawater and other damaging elements of the subsea environment.

With reference to FIG. 10, the primary seal 420 and the secondary seal 426 may each be constructed of an elastomeric material. For example, the primary seal 420 and/or the secondary seal 426 may be an O-ring. In other embodiments, the primary seal 420 and/or the secondary seal 426 may be a lip seal or a u-cup seal. Those of ordinary skill in the art will appreciate that other seal types may be utilized as the primary seal 420 and/or the secondary seal 426 without departing from the scope of this disclosure.

The primary chamber 422 and the secondary chamber 428 of FIG. 10 may be fluidly coupled with one another via a primary fluid flowpath (indicated by dashed line 430) and a secondary fluid flowpath (indicated by dashed line 432). Similar to the embodiment illustrated in FIGS. 4-7, the corrosion inhibitor fluid may be injected into the primary chamber 422 via the primary fluid flowpath 430 formed in part by the primary inlet port 442 defined by and extending through the upper portion of the protective cap body 1002. The primary fluid flowpath 420 is further defined by one or more primary outlet ports 1054 defined by the cylindrical sidewall 404 and fluidly coupled to the check valve 460 via the conduit 484. The primary outlet port 1054 may be positioned above and proximal the primary seal 420 at the lower end portion of the primary chamber 422. The check valve 460 may fluidly couple the primary and secondary fluid flowpaths 430 and 432, such that the check valve 460 is fluidly coupled to a secondary inlet port 487 for the secondary chamber 428 via another conduit 486. The secondary inlet port 487 may be defined by the cylindrical sidewall 404 and located below the primary seal 420. The cylindrical sidewall 404 may further define one or more secondary outlet ports (one shown 488) for the secondary chamber 428 at the bottom of the secondary chamber 428 and above the secondary seal 426, thereby fluidly coupling the secondary fluid flowpath 432 with the external subsea environment to vent excess fluid to the subsea environment. The secondary outlet port(s) 488 may include a check valve (not shown). In another embodiment, the secondary outlet port(s) 488 may include a screen fitting (not shown). In the embodiment as shown in FIG. 10, the secondary outlet port(s) 488 may be unobstructed.

In an embodiment directed to a heavy corrosion inhibitor fluid for a subsea tree application, although not shown, those of ordinary skill in the art will understand that the primary inlet port 442 for the primary chamber 422 may be disposed at the bottom of the primary chamber 422, and the primary outlet port 454 may be disposed at the top of the primary chamber 422, and the secondary inlet port 487 for the secondary chamber 428 may be disposed at the bottom of the secondary chamber 428, and the secondary outlet port 488 may be disposed at the top of the secondary chamber 428.

The protective cap assembly 1000 of FIG. 10 may have an active locking system 700 including one or more locking assemblies 702 configured to engage and disengage with a mandrel 110 of a subsea tree via an ROV. Each locking assembly 702 may be further configured to couple the protective cap body 402 with and maintain a sealing relationship with the mandrel 110 to allow a corrosion inhibitor fluid to be injected into the protective cap assembly 400 to prevent corrosion and/or the formation of deposits on the mandrel. As shown in FIG. 10, the locking assembly 702 may further include an actuator 828 integral with or operatively coupled to a locking pin 830 and configured to selectively engage and disengage the locking pin 830 from the angled shoulder surface 113 of the subsea tree mandrel 1092.

Figure 11:
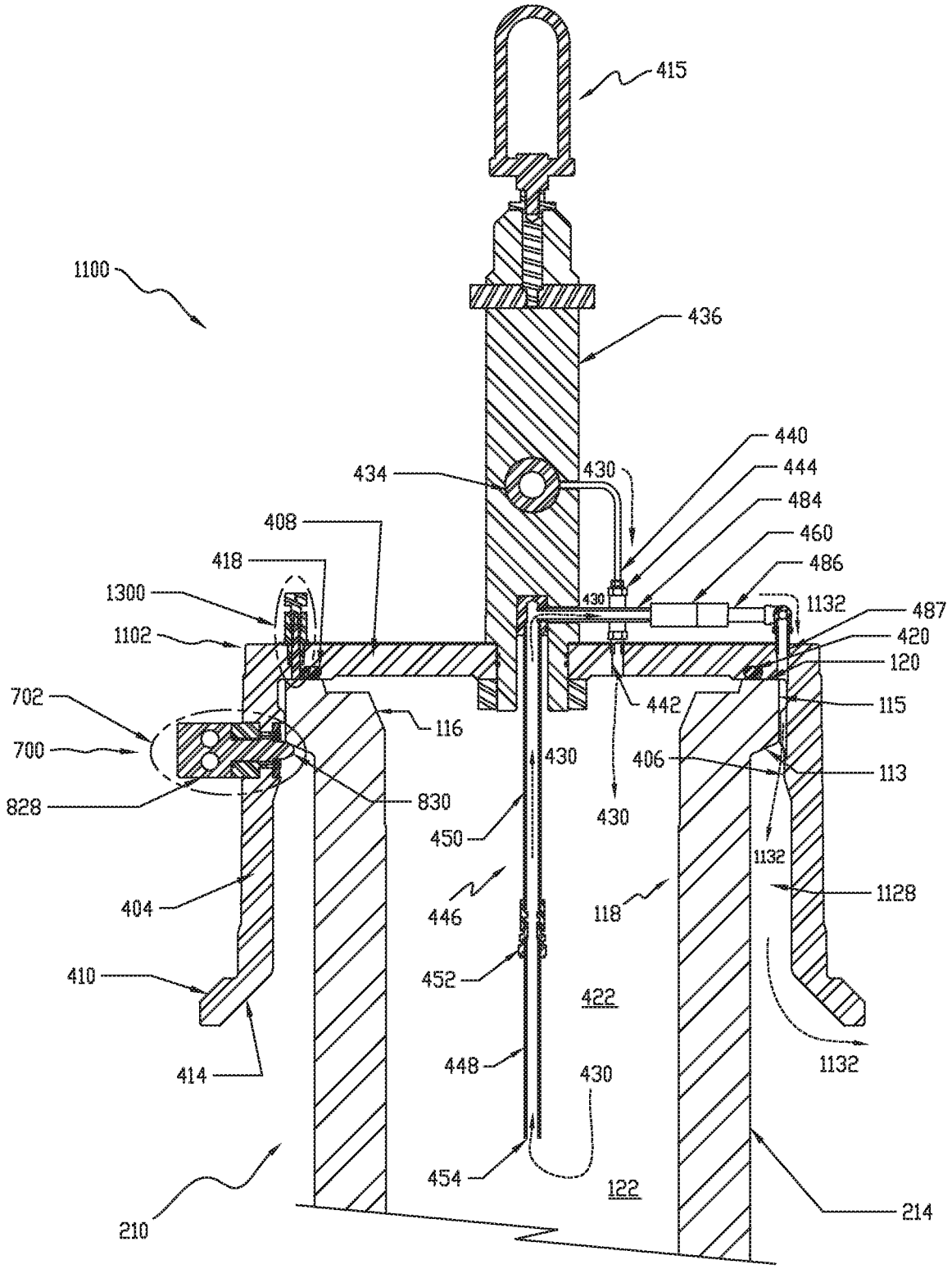
FIG. 11 illustrates a cross sectional view of another example protective cap assembly disposed on and coupled to a subsea equipment hub, according to one or more embodiments of the disclosure.

Referring now to FIG. 11, FIG. 11 illustrates a cross sectional view of another example protective cap assembly 1100 disposed on and coupled to a subsea equipment hub 210, according to one or more embodiments of the disclosure. The protective cap assembly 1100 may be similar in some respects to the protective cap assembly 400 described above and thus may be best understood with reference to FIGS. 4-7 and the description thereof, where like numerals designate like components and will not be described again in detail.

As illustrated in FIG. 11, the protective cap assembly 1100 may include a protective cap body 1102 configured to be disposed on the hub 210. The protective cap body 1102 may include a cylindrical sidewall 404 having an inner cylindrical surface 406 configured to be disposed about the upper outer circumferential surface 115 of the hub 210. Further, the upper end portion of the cylindrical sidewall 404 may be coupled to or integral with a top plate 408 of the protective cap body 1102. An inner surface 416 of the top plate 408 may define an annular groove 418 configured to seat therein a primary seal 420 of the protective cap assembly 1100. The primary seal 420 may be disposed in the annular groove 418 such that the primary seal 420 engages a top face 120 of the hub 210 in a sealing relationship therewith when disposed thereon. In another embodiment, the primary seal 420 may be disposed in an annular groove 418 to contact the upper outer circumferential surface 115 at the top of the hub 210. In both embodiments, the primary seal 420, the top plate 408, the top face 120, and the inner circumferential surface 118 of the hub 210 form at least in part a primary chamber 422 within the bore 122 of the hub 210 and inwards of the primary seal 420.

The large upper outer circumferential surface 115 of the hub 210 may create a significant annular gap between the inner circumferential surface 406 of the protective cap body 1102 and the smaller main outer circumferential surface 214. An annular cavity 1128 may be formed in part by the main outer circumferential surface 214, the angled shoulder surface 113, the inner circumferential surface 406, and open to the subsea environment at the bottom. As shown in FIG. 11, the fluid exiting the primary chamber 422 via a primary fluid flowpath 430 to a conduit 484 and a check valve 460 may be directed via a secondary fluid flowpath 1132 through a conduit 486 to a secondary inlet port 487 that is fluidly coupled to the annular cavity 1128, with any excess fluids directed from the annular cavity 1128 at the bottom to the external subsea environment. In another embodiment, the fluid exiting the primary chamber 422 via the primary fluid flowpath 430 may be directed via the check valve 460 directly to the subsea environment.

With reference to FIG. 11, the primary seal 420 may each be constructed of an elastomeric material. For example, the primary seal 420 may be an O-ring. In other embodiments, the primary seal 420 may be a lip seal or a u-cup seal. Those of ordinary skill in the art will appreciate that other seal types may be utilized as the primary seal 420 without departing from the scope of this disclosure.

The protective cap assembly 1100 of FIG. 11 may have an active locking system 700 including one or more locking assemblies 702 configured to engage and disengage with a hub 210 of a subsea wellhead assembly, a subsea tubing head spool, a subsea tree, or similar subsea equipment via an ROV. Each locking assembly 702 may be further configured to couple the protective cap body 402 with and maintain a sealing relationship with the hub 210 to allow a corrosion inhibitor fluid to be injected into the protective cap assembly 400 to prevent corrosion and/or the formation of deposits on the hub. As shown in FIG. 11, the locking assembly 702 may further include an actuator 828 integral with or operatively coupled to a locking pin 830 and configured to selectively engage and disengage the locking pin 830 from the angled shoulder surface 113 of the hub.

Figure 12:
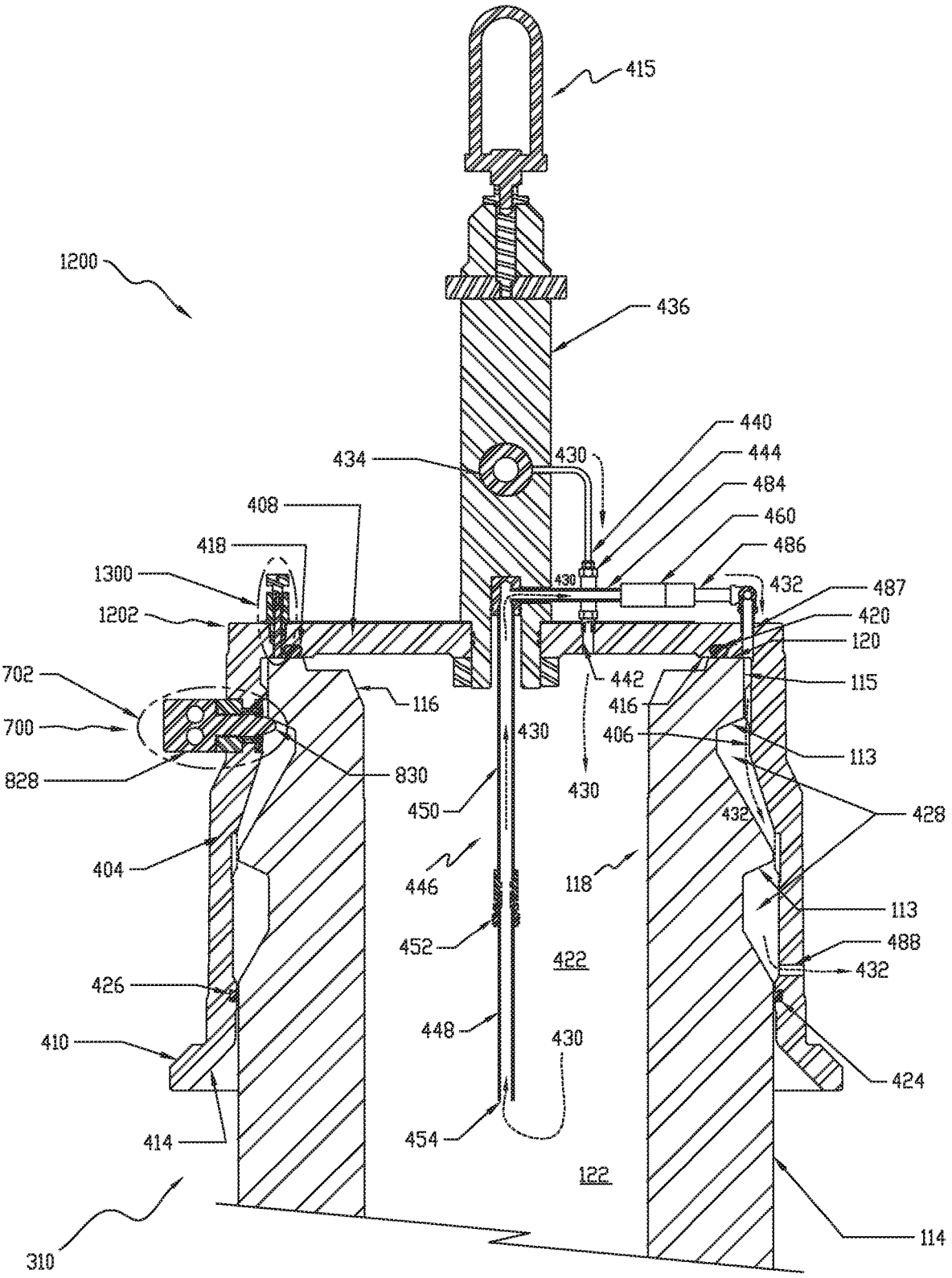
FIG. 12 illustrates a cross sectional view of another example protective cap assembly disposed on and coupled to a dual hub for a subsea wellhead or subsea tree, according to one or more embodiments of the disclosure.

Referring now to FIG. 12, FIG. 12 illustrates a cross sectional view of another example protective cap assembly 1200 disposed on and coupled to the dual hub 310, according to one or more embodiments of the disclosure. The protective cap assembly 1200 may be similar in some respects to the protective cap assembly 400 described above and thus may be best understood with reference to FIGS. 4-7 and the description thereof, where like numerals designate like components and will not be described again in detail.

As illustrated in FIG. 12, the protective cap assembly 1200 may include a protective cap body 1202 configured to be disposed on a dual hub 310. The protective cap body 1202 may include a cylindrical sidewall 404 having an inner cylindrical surface 406 configured to be disposed about the upper outer circumferential surface 115, the circumferential grooves 112, and the main outer circumferential surface 114 of the dual hub 310. Further, the upper end portion of the cylindrical sidewall 404 may be coupled to or integral with a top plate 408 of the protective cap body 1202. An inner surface 416 of the top plate 408 may define an annular groove 418 configured to seat therein a primary seal 420 of the protective cap assembly 1200. The primary seal 420 may be disposed in the annular groove 418 such that the primary seal 420 engages a top face 120 of the dual hub 310 in a sealing relationship therewith when disposed thereon. In another embodiment, the primary seal 420 may be disposed in an annular groove 418 defined by the inner cylindrical surface 406 to contact the upper outer circumferential surface 115 at the top of the dual hub 310. In both embodiments, the primary seal 420, the top plate 408, the top face 120, and the inner circumferential surface 118 of the dual hub 310 form at least in part a primary chamber 422 inwards of the primary seal 420.

As shown in FIG. 12, the cylindrical sidewall 404 may further define another annular groove 424 configured to seat therein a secondary seal 426 of the protective cap assembly 1200. The secondary seal 426 may be disposed in the annular groove 424 such that the secondary seal 426 engages the main outer circumferential surface 114 of the dual hub 310 in a sealing relationship therewith below the plurality of circumferential grooves 112. The primary seal 420 and the secondary seal 426 define respective upper and lower ends of a secondary chamber 428 formed at least in part between the main outer circumferential surface 114 of the dual hub 310 and the inner cylindrical surface 406 of the cylindrical sidewall 404. The primary chamber 422 and the secondary chamber 428 may be fluidly coupled with one another via a primary fluid flowpath (indicated by dashed line 430) and a secondary fluid flowpath (indicated by dashed line 432) with a check valve 460 to selectively prevent fluid from exiting the primary chamber 422. The secondary fluid flowpath 432 may be further defined by a secondary inlet port 487 in the protective cap body 902 that provides an injection point for fluid to enter the secondary chamber 428. The cylindrical sidewall 404 may further define one or more secondary outlet ports (one shown 488) for the secondary chamber 428 at the bottom of the secondary chamber 428 and above the secondary seal 426, thereby fluidly coupling the secondary fluid flowpath 432 with the external subsea environment to vent excess fluid to the subsea environment. The secondary outlet port(s) 488 may include a check valve (not shown). In another embodiment, the secondary outlet port(s) 488 may include a screen fitting (not shown). In the embodiment as shown in FIG. 9, the secondary outlet port(s) 488 may be unobstructed.

With reference to FIG. 12, the primary seal 420 and the secondary seal 426 may each be constructed of an elastomeric material. For example, the primary seal 420 and/or the secondary seal 426 may be an O-ring. In other embodiments, the primary seal 420 and/or the secondary seal 426 may be a lip seal or a u-cup seal. Those of ordinary skill in the art will appreciate that other seal types may be utilized as the primary seal 420 and/or the secondary seal 426 without departing from the scope of this disclosure.

The protective cap assembly 1200 of FIG. 12 may have an active locking system 700 including one or more locking assemblies 702 configured to engage and disengage with a dual hub 310 of a subsea wellhead assembly, a subsea tubing head spool, a subsea tree, or similar subsea equipment via an ROV. Each locking assembly 702 may be further configured to couple the protective cap body 402 with and maintain a sealing relationship with the dual hub 310 to allow a corrosion inhibitor fluid to be injected into the protective cap assembly 400 to prevent corrosion and/or the formation of deposits on the dual hub 310. As shown in FIG. 12, the locking assembly 702 may further include an actuator 828 integral with or operatively coupled to a locking pin 830 and configured to selectively engage and disengage the locking pin 830 from the angled shoulder surface 113 of the dual hub 310.

Figure 13:
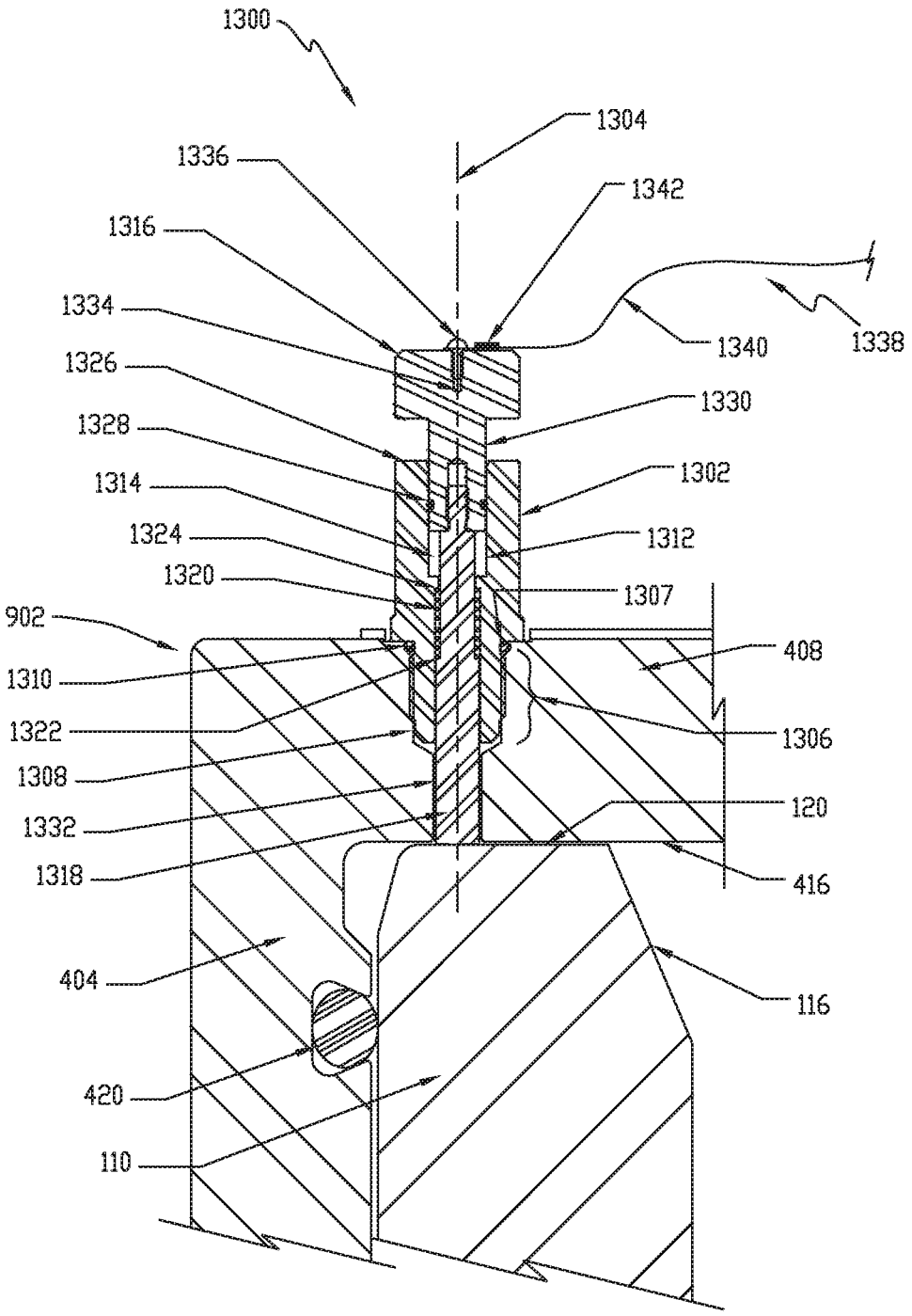
FIG. 13 illustrates an enlarged cross sectional view of an example indicator rod assembly for a protective cap assembly, according to one or more embodiments of the disclosure.

In one or more embodiments, in order to ensure reliability of the locking and sealing of the protective cap assembly with a mandrel or hub, the protective cap assembly 400, 900, 1100, 1200 may be further configured to provide visual feedback when the protective cap assembly 400, 900, 1100, 1200 is in proximal contact with a top face 120 of a mandrel 110, hub 210, or dual hub 310. As shown in FIG. 9, the protective cap assembly 900 may include a sealed, spring-biased indicator rod assembly 1300 configured to provide visual feedback for an ROV when the protective cap body 902 is in proximal contact with the top face 120 of the mandrel 110 during installation of the protective cap assembly 900 on the mandrel 110. FIG. 13 illustrates an enlarged cross sectional view of the indicator rod assembly 1300, according to one or more embodiments of the disclosure. Although most clearly illustrated with reference to the protective cap assembly 900 of FIG. 9, it will be appreciated that the indicator rod assembly 1300 may be included in other example protective cap assemblies disclosed herein. For example, the indicator rod assembly 1300 may be included in the protective cap assembly 400, as illustrated in FIG. 4, the protective cap assembly 1100, as illustrated in FIG. 11, or the protective cap assembly 1200, as illustrated in FIG. 12.

The indicator rod assembly 1300 may include an indicator body 1302 having a longitudinal axis 1304 and a threaded lower end portion 1306 configured to threadingly engage with a threaded port 1308 defined by and extending through the top plate 408 of the protective cap assembly 800. As engaged with the top plate 408, an elastomeric seal 1310 (e.g., an O-ring) may be disposed in an indicator body groove 1311 defined by the threaded lower end portion 1306 and arranged in a sealing relationship with the top plate 408. An inner circumferential surface 1312 of the indicator body 1302 may define an indicator body chamber 1314 in which an upper piston 1316 and a lower piston 1318 may be coupled with one another and travel along the longitudinal axis 1304.

A biasing member 1320, illustrated as a compression spring, may be disposed about the lower piston 1318, seated on a shoulder 1322 thereof and on an axially opposing shoulder 1324 of the indicator body, and arranged to bias the lower piston 1318 downward, such that the upper piston 1316 coupled thereto contacts a top face 1326 of the indicator body 1302 during installation of the protective cap assembly 800 to the mandrel 110. During installation and operation of the protective cap assembly 800, as the lower piston 1318 is brought into contact with the top face 120 of the mandrel 110, the upper piston 1316 is urged upward and away from the top face 1326 of the indicator body 1302, thereby providing visual indication of the protective cap assembly 800 being in proximal contact with the top face 120 of the mandrel 110. To provide sealing, an elastomeric seal 1328 (e.g., an O-ring) may be mounted in a groove formed in an outer circumferential surface 1330 of the upper piston 1316 and engaging the inner circumferential surface 1312 of the indicator body 1302, thereby isolating the primary chamber 422 from the external subsea environment. In another embodiment, the elastomeric seal 1328 may be mounted in a groove formed in an outer circumferential surface 1332 of the lower piston 1318 and contacting the inner circumferential surface 1312 of the indicator body 1302, thereby containing the corrosion inhibitor fluid within the protective cap assembly 800. In one or more embodiments, the upper piston 1316 may further define a threaded hole 1334 configured to accept a mechanical fastener 1336 (e.g., a machine screw) to attach a wire or grounding lead 1338. The grounding lead 1338 may include a conductive wire 1340 and one or more terminal fittings (one shown 1342). The grounding lead 1338 may be utilized to provide a path for electrical continuity from other metallic components external of the protective cap assembly 900 through the protective cap body 902 directly to the mandrel 110.

Figure 14:
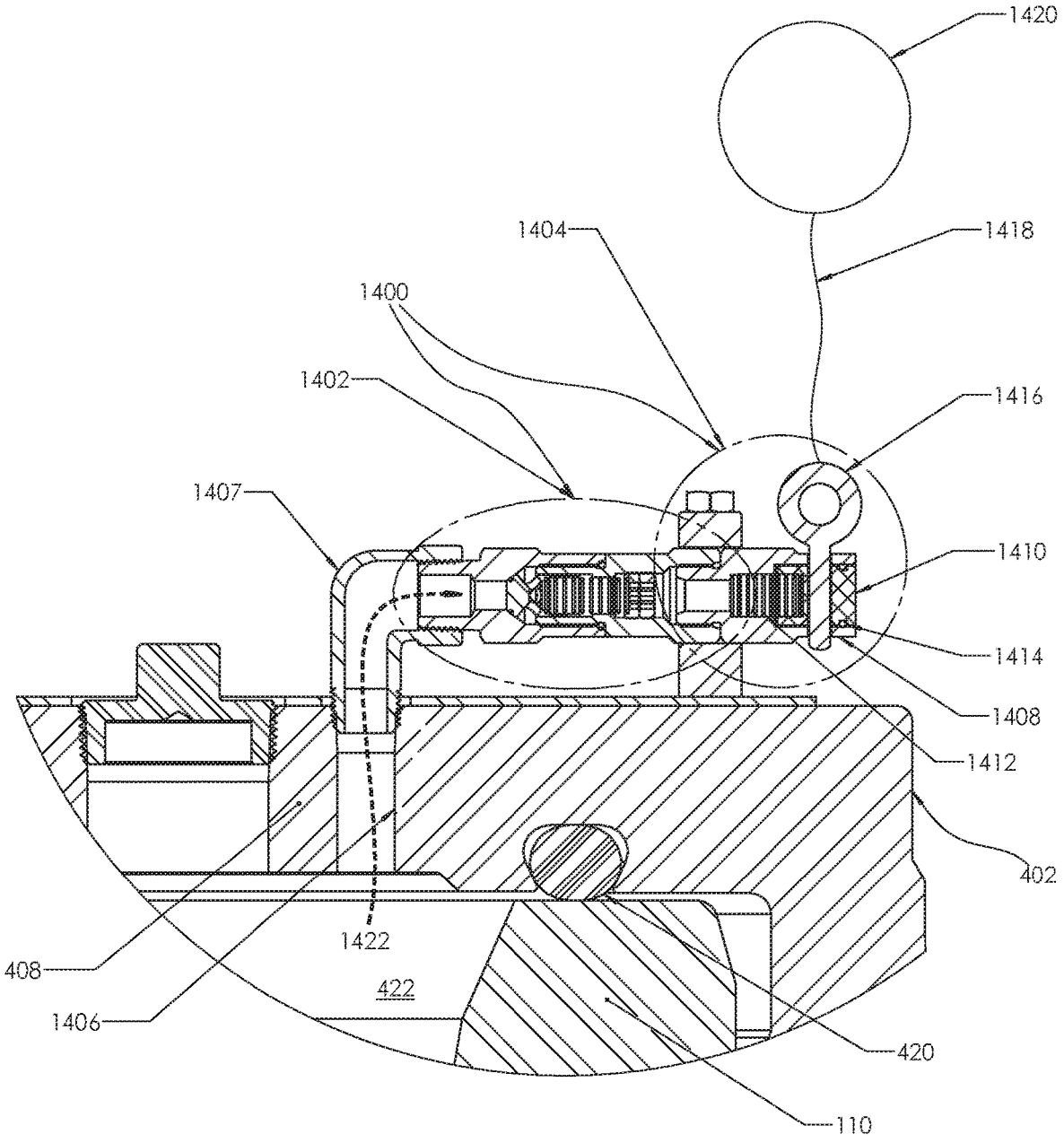
FIG. 14 illustrates an enlarged cross sectional view of an example gas venting valve assembly mounted to a top plate of a protective cap assembly, according to one or more embodiments of the disclosure.

In one or more embodiments, in order to allow natural gas, methane, carbon dioxide and other gases to be released from under from the protective cap assembly 400 while retaining the injected corrosion inhibitor fluid, the protective cap assembly 400 may include a gas venting valve assembly 1400. FIG. 14 illustrates an enlarged cross sectional view of the gas venting valve assembly 1400 mounted to the top plate 408, according to one or more embodiments of the disclosure, to provide a gas venting flowpath 1422 from the primary chamber 422.

The gas venting valve assembly 1400 may include a one-way check valve 1402 fluidly coupled with an ROV actuated valve assembly 1404. In at least one embodiment, a one-way check valve 1402 with adjustment feature may be used to provide a precise valve opening pressure, similar in function to check valve 460. The gas venting valve assembly 1400 may be fluidly coupled with a gas outlet port 1406 defined by the protective cap body 402 of the protective cap assembly 400 and configured to provide an outlet for any gas that accumulates in the primary chamber 422. Accordingly, the gas venting valve assembly 1400 may include the check valve 1402 fluidly coupled with the gas outlet port 1406 via a conduit 1407 and configured such that the specified opening pressure for the check valve 1402 is selected to be lower than opening pressure of the check valve 460 disposed in the primary fluid flowpath 430. The ROV actuated valve assembly 1404 may be configured to be closed during the injection of the corrosion inhibitor fluid. After the injection of the corrosion inhibitor fluid is completed, the ROV actuated valve assembly 1404 may be opened or otherwise enabled to allow for venting of any gas accumulating in the primary chamber 422 if the gas pressure exceeds a predetermined opening pressure of the check valve 1402.

As shown in FIG. 14, the ROV actuated valve assembly 1404 may be an ROV-enabled plug-type valve. The ROV-enabled plug-type valve may include a valve body 1408, a piston 1410, a spring 1412, an elastomeric seal 1414 (e.g., O-ring), and a pull pin 1416, connected with to a small float 1420 via a rope 1418. The ROV-enabled plug-type valve will remain closed until the ROV removes the pull pin 1416, at which point any internal pressure will displace the piston 1410 assisted by the spring 1412. In another embodiment, the ROV actuated valve assembly may be an ROV-operated shut-off valve (not shown) with an ROV handle to allow the ROV to close or open the valve.

Figure 15:
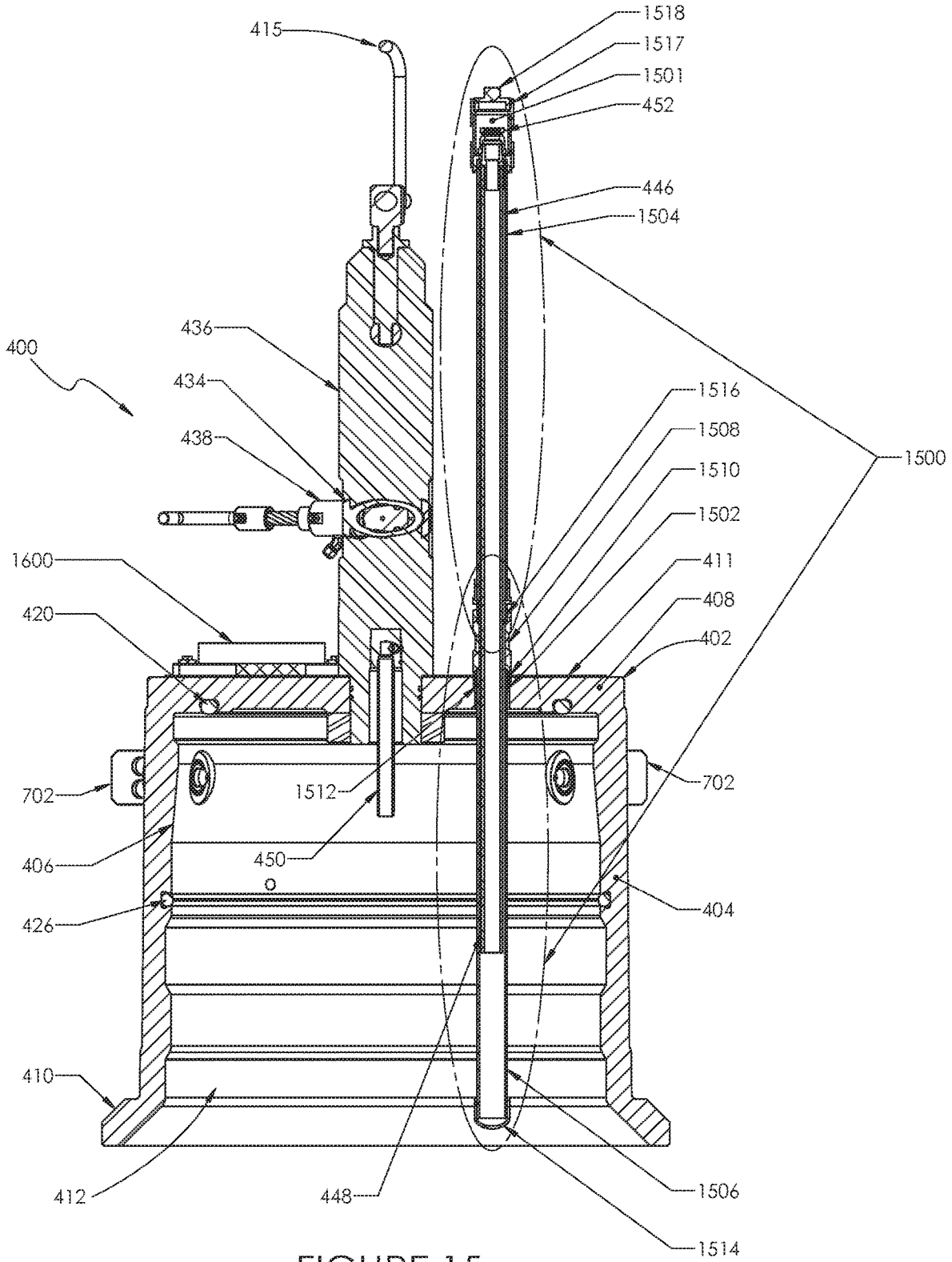
FIG. 15 illustrates a cross section view of an example storage tube assembly coupled to a protective cap body of the protective cap assembly, according to one or more embodiments of the disclosure.

Looking now at FIG. 15 with continued reference to FIGS. 4-7, FIG. 15 illustrates a storage tube assembly 1500 coupled to the protective cap body 402 of the protective cap assembly 400, according to one or more embodiments of the disclosure. As the vent pipe extension 448 may extend from the opening 412 of the protective cap body 402, the vent pipe extension 448 may be susceptible to damage if coupled to the main vent pipe 450 during transport. Accordingly, the storage tube assembly 1500 may be configured to provide a storage tube cavity 1501 for storage and protection of the vent pipe extension 448 during transport of the protective cap assembly 400. During transport, the storage tube assembly 1500 containing the vent pipe extension 448 may be inserted through a threaded port 1502 defined by the top plate 408 of the protective cap body 402. The storage tube assembly 1500 may include an upper tube 1504 and a lower tube 1506 coupled with one another via a central adapter fitting 1508. The central adapter fitting 1508 may have external threads 1510 for attachment to the threaded port 1502 in the top plate 408 and may further define at a lower end a socket 1512 for attaching the lower tube 1506 inserted therein by gluing, bonding or threading. The lower tube 1506 may include a plug or cap 1514 to seal a bottom end portion thereof. The upper end of the central adapter fitting 1508 may define a socket 1516 for attaching the upper tube 1504 inserted therein by gluing, bonding or threading. The upper tube 1504 also may be closed at the top end portion via a threaded plug 1518 or cap. As illustrated in FIG. 15, the upper tube 1504 may have a threaded adapter at the top end portion thereof for coupling with the threaded plug or cap 1518. After shipment in preparation for installation, the shipping tube assembly 1500 may be decoupled from the top plate 408 via the central adapter fitting 1508, and the vent pipe extension 448 may be removed from the storage tube cavity 1501 defined by the upper tube 1504 and the lower tube 1506. The vent pipe extension 448 may then be attached to the main vent pipe 450. Accordingly, the shipping tube assembly 1500 is thus removed from the protective cap body 402 and may be discarded. A threaded plug may be installed in the threaded port 1502 in the top plate 408 to seal the primary chamber 422 from the external subsea environment, utilizing threaded plug 1518 in one or more embodiments.

Figure 16:
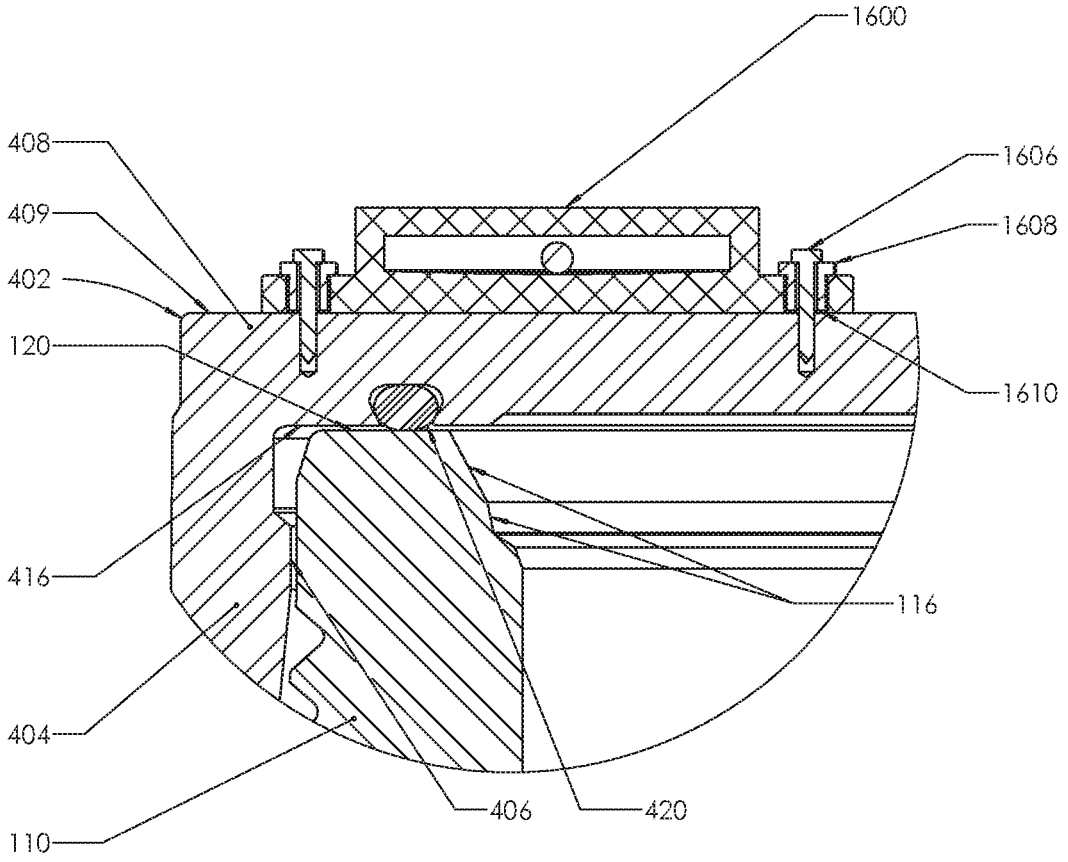
FIG. 16 illustrates an enlarged cross sectional view of an example subsea level indicator mounted to a top plate surface of the protective cap body of the protector cap assembly, according to one or more embodiments of the disclosure.
Figure 17:
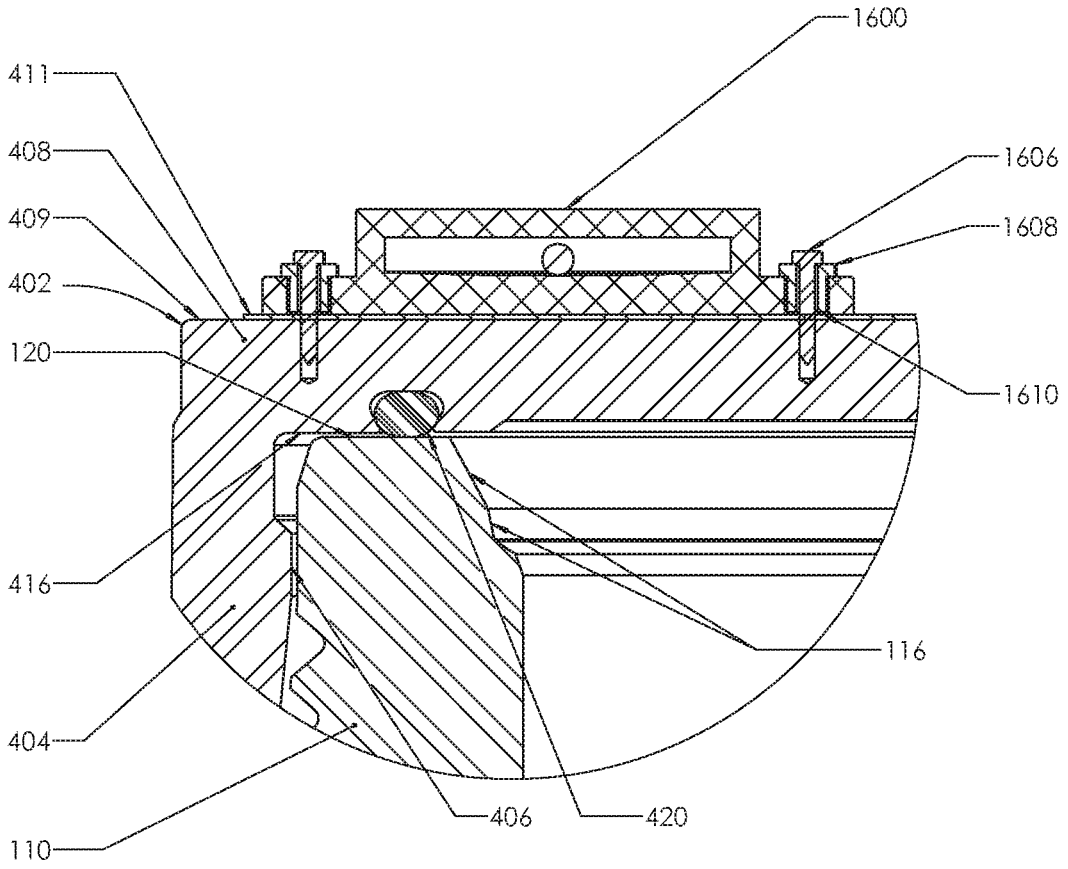
FIG. 17 illustrates an enlarged cross sectional view of the subsea level indicator mounted indirectly to a top surface of the protective cap body via a protective disk, according to one or more embodiments of the disclosure.

In one or more embodiments, to reduce operator costs to perform wellhead and tree angle surveys, the protective cap assembly 400 may include a subsea level indicator 1600 as shown in FIGS. 4-7, 16, and 17. FIG. 16 illustrates an enlarged cross sectional view of the subsea level indicator 1600 mounted directly to a top surface 409 of the top plate 408 of the protective cap assembly 400, according to one or more embodiments of the disclosure. In another embodiment in FIG. 17, FIG. 17 illustrates an enlarged cross sectional view of the subsea level indicator 1600 mounted indirectly to the top plate 408 of the protective cap assembly 400 via a protective disk 411, according to one or more embodiments of the disclosure. As illustrated most clearly in FIGS. 16 and 17, the subsea level indicator 1600 may be a visual bullseye level indicator; however, the disclosure is not limited thereto, as other visual level indicators or electronic level indicators are contemplated within the scope of this disclosure.

The inner surface 416 of the top plate 408 may provide a landing surface for the protective cap assembly 400 on or near the top face 120 of the mandrel 110, thereby providing a stable surface to register the angle of the mandrel 110, whereby the inner surface 416 of the protective cap assembly 400 is substantially parallel to the top face 120 of the mandrel 110. The subsea level indicator 1600 may be mounted directly to the top surface 409 of the top plate 408 as shown in FIG. 16. In the other embodiment shown in FIG. 17, the subsea level indicator 1600 may be mounted to the top surface of the protective disc 411, and the protective disc 411 may be mounted to the top surface 409 of the top plate 408. The subsea level indicator 1600 may be mounted to the top plate 408, directly or indirectly via the protective disc 411, by one or more mechanical fasteners, including, but not limited to, screws, bolts, adapter fittings, and spring washers. In one or more embodiments, the subsea level indicator

1600 may be mounted to the top plate 408 via a plurality of screws 1606 and adapter fittings 1608. In at least one embodiment, spring washers 1010 in conjunction with the mechanical fasteners (e.g., the screws 1606 and fittings 1608) to provide electrical continuity for each screw 1606 and adapter fitting 1608 to the protective disc 411 to avoid corrosion of the screw 1606.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

I claim:

1. An apparatus for installation to a subsea equipment mandrel or hub, comprising:

a body having a body longitudinal axis and a cylindrical sidewall extending axially along the body longitudinal axis, the cylindrical sidewall defining one or more receptacles and forming a respective shoulder within each receptacle in the cylindrical sidewall; and a locking system coupled to the body and configured to couple the body to the mandrel or hub, the locking system comprising;

one or more locking assemblies, each locking assembly configured to be received within a respective receptacle and coupled to the cylindrical sidewall, each locking assembly comprising:

a locking body comprising a main locking body portion and a secondary locking body portion, the secondary locking body portion extending from the main locking body portion, the locking body further defining a first annular groove near a junction of the main locking body portion and the secondary locking body portion;

a first annular seal seated within the first annular groove and configured to engage the shoulder in a sealing relationship therewith;

a first locking collar configured to couple the locking body to the cylindrical sidewall, such that the first locking collar is coupled with the secondary locking body portion and seated against an interior face of the shoulder and a main locking body interior surface is seated against an exterior face of the shoulder;

an actuator comprising a main actuator portion and being adjustably coupled to the locking body and configured to move radially toward or away from an angled shoulder surface of the mandrel or hub;

a second annular groove;

a second annular seal seated in the second annular groove, the second annular seal sealing the actuator to the locking body; and a locking pin integral or coupled with the actuator and configured to selectively engage the angled shoulder surface of the mandrel or hub, such that when extended, the locking pin couples the body to the mandrel or hub.

2. The apparatus of claim 1, wherein:

the main actuator portion has an outer surface, an inner surface, and an end face, the outer surface being adjustably coupled to the locking body, and the inner surface defining an actuator locking pin bore configured to receive therein a discrete locking pin; and the locking pin includes a locking pin head and a locking pin shaft, wherein:

the locking pin head has a first surface and a second surface, the first surface shaped to generally conform to an angled shoulder surface of the mandrel or hub and the second surface seated against the end face of the main actuator portion; and the locking pin shaft extends from the second surface of the locking pin head, the locking pin shaft configured to be installed to the actuator locking pin bore.

3. The apparatus of claim 2, wherein:

the locking pin defines a third annular groove at a location adjacent a junction of the locking pin head and locking pin shaft, and the locking pin is configured to shear at the location of the third annular groove in the event that a predetermined load rating is exceeded.

4. The apparatus of claim 2, wherein the locking pin defines a vent channel extending through the locking pin head and the locking pin shaft, the vent channel configured to fluidly couple the actuator locking pin bore to the external subsea environment.

5. The apparatus of claim 2, wherein the actuator further defines a vent channel extending through the main actuator portion from the actuator locking pin bore to the external subsea environment, the vent channel configured to fluidly couple the actuator locking pin bore to the external subsea environment.

6. The apparatus of claim 1, wherein:

an outer cylindrical surface of the cylindrical sidewall defines each receptacle predominantly in the shape of a rectangle, an outer surface of the main locking body portion of each locking body is defined predominantly in the shape of a rectangle, and the main locking body portion is configured to engage the rectangular portion of a receptacle in the cylindrical sidewall.

7. The apparatus of claim 1, wherein:

the actuator further comprises a remotely operated vehicle (ROV) interface member having an exterior ROV handle;

the main actuator portion extends from the ROV interface member and has an actuator longitudinal axis; and the main actuator portion is configured to rotate in a clockwise or a counterclockwise direction about the actuator longitudinal axis and to move radially in relation to the locking body in response to the rotational input.

8. The apparatus of claim 7, wherein:

the ROV interface member has an interior surface;

the main locking body portion includes an exterior surface that defines a fourth annular groove; and an annular component is disposed within the fourth annular groove defined by the exterior surface of the main locking body and protruding therefrom, the annular component configured to engage the interior surface of the ROV interface member as the actuator is moved radially toward the angled shoulder surface of the mandrel or hub, and the annular component further configured to prevent contact between the interior surface of the ROV interface member and the exterior surface of the main locking body.

9. The apparatus of claim 1, wherein:

the actuator has an actuator longitudinal axis;

the main actuator portion is coupled to a hydraulic piston configured to receive hydraulic fluid from a hydraulic fluid source; and the actuator is configured to move radially along the actuator longitudinal axis in relation to the locking body in response to the hydraulic fluid supplied from the hydraulic fluid source.

10. The apparatus of claim 1, wherein:

each of the main actuator portions includes a respective end portion; and each of the one or more locking assemblies further comprises:

a second locking collar coupled to the end portion of the main actuator portion and configured to retain the actuator in a coupled relationship with the locking body, the second locking collar including an outer surface defining the second annular groove; and the second annular seal seated within the second annular groove defined by the second locking collar, such that the second annular seal engages an inner surface of the secondary locking body portion in a sealing relationship therewith.

11. An apparatus for installation to a mandrel or hub disposed in a subsea environment, comprising:

a body having a body longitudinal axis and a cylindrical sidewall extending axially along the body longitudinal axis, the cylindrical sidewall defining one or more receptacles and forming a respective shoulder within each receptacle in the cylindrical sidewall; and a locking system coupled to the body and configured to couple the body to the mandrel or hub, the locking system comprising:

one or more locking assemblies, each locking assembly configured to be received within a respective receptacle and coupled to the cylindrical sidewall, each locking assembly comprising a locking body comprising a main locking body portion and a secondary locking body portion, the secondary locking body portion extending from the main locking body portion, the main locking body portion further comprising a main locking body portion exterior surface and a main locking body interior surface;

a first locking collar configured to couple the locking body to the cylindrical sidewall such that the first locking collar is coupled with the secondary locking body portion and seated against an interior face of the shoulder and the main locking body portion interior surface is seated against an exterior face of the shoulder;

an actuator adjustably coupled to the locking body and configured to move radially toward or away from an angled shoulder surface of the mandrel or hub, the actuator further comprising a main actuator portion having an outer surface and an inner surface, the outer surface of the main actuator portion being adjustably coupled to the locking body, and the inner surface of the main actuator portion defining an actuator locking pin bore; and a locking pin coupled with the actuator and configured to selectively engage the angled shoulder surface of the mandrel or hub, such that when extended, the locking pin couples the body to the mandrel or hub, the locking pin comprising a locking pin head and a locking pin shaft, the locking pin head having a first surface and a second surface, the first surface shaped to generally conform to the angled shoulder surface of the mandrel or hub, and the locking pin shaft extending from the second surface of the locking pin head, the locking pin shaft configured to be installed to the actuator locking pin bore, wherein the locking pin defines a first annular groove at a location adjacent a junction of the locking pin head and locking pin shaft, and the locking pin is configured to shear at the location of the first annular groove in the event that a predetermined load rating is exceeded.

12. The apparatus of claim 11, wherein the locking pin defines a vent channel extending through the locking pin head and the locking pin shaft, the vent channel configured to fluidly couple the actuator locking pin bore to the external subsea environment.

13. The apparatus of claim 11, wherein:

the actuator further comprises a remotely operated vehicle (ROV) interface member having an exterior ROV handle;

the main actuator portion extends from the ROV interface member and has an actuator longitudinal axis; and the main actuator portion is configured to rotate in a clockwise or a counterclockwise direction about the actuator longitudinal axis and to move radially in relation to the locking body in response to the rotational input.

14. The apparatus of claim 11, wherein:

the actuator has an actuator longitudinal axis;

the main actuator portion is coupled to a hydraulic piston configured to receive hydraulic fluid from a hydraulic fluid source; and the actuator is configured to move radially along the actuator longitudinal axis in relation to the locking body in response to the hydraulic fluid supplied from the hydraulic fluid source.

15. The apparatus of claim 11, wherein:

the locking body defines a second annular groove near a junction of the main locking body portion and the secondary locking body portion;

a first annular seal is seated within the second annular groove and configured to engage the shoulder within each receptacle of the cylindrical sidewall in a sealing relationship therewith;

the locking assembly further comprises a second locking collar coupled to an end portion of the main actuator portion and configured to retain the actuator in a coupled relationship with the locking body, wherein an outer surface of the second locking collar defines a third annular groove; and a second annular seal seated within the third annular groove defined by the second locking collar, such that the second annular seal engages an inner surface of the secondary locking body portion in a sealing relationship therewith.

16. An apparatus for installation to a mandrel or hub disposed in a subsea environment, comprising:

a body having a body longitudinal axis and a cylindrical sidewall extending axially along the body longitudinal axis, the cylindrical sidewall defining one or more receptacles and forming a respective shoulder within each receptacle in the cylindrical sidewall; and a locking system configured to couple the body to the mandrel or hub, the locking system comprising:

one or more locking assemblies, each locking assembly configured to be received within a respective receptacle and coupled to the cylindrical sidewall, each locking assembly comprising:

a locking body comprising a main locking body portion and a secondary locking body portion extending from the main locking body portion, the main locking body portion further comprising a main locking body portion exterior surface and a main locking body interior surface;

a first locking collar configured to couple the locking body to the cylindrical sidewall, such that the first locking collar is coupled with the secondary locking body portion and seated against an interior face of the shoulder and the main locking body portion interior surface is seated against an exterior face of the shoulder;

an actuator adjustably coupled to the locking body and configured to move radially toward or away from an angled shoulder surface of the mandrel or hub, the actuator further comprising a main actuator portion having an outer surface and an inner surface, the outer surface of the main actuator portion being adjustably coupled to the locking body, and the inner surface of the main actuator portion defining an actuator locking pin bore; and a locking pin coupled with the actuator and configured to selectively engage the angled shoulder surface of the mandrel or hub, such that when extended, the locking pin couples the body to the mandrel or hub, the locking pin comprising:

a locking pin head and a locking pin shaft, the locking pin head having a first surface and a second surface, the first surface shaped to generally conform to the angled shoulder surface of the mandrel or hub, and the locking pin shaft extending from the second surface of the locking pin head, the locking pin shaft configured to be installed to the actuator locking pin bore, and a vent channel extending through the locking pin head and the locking pin shaft, the vent channel configured to fluidly couple the actuator locking pin bore to the subsea environment.

17. The apparatus of claim 16, wherein:

the actuator further comprises a remotely operated vehicle (ROV) interface member having an exterior ROV handle;

the main actuator portion extends from the ROV interface member and has an actuator longitudinal axis; and the main actuator portion is configured to rotate in a clockwise or a counterclockwise direction about the actuator longitudinal axis and to move radially in relation to the locking body in response to the rotational input.

18. The apparatus of claim 16, wherein:

the locking pin defines a groove at location adjacent a junction of the locking pin head and locking pin shaft, and the locking pin is configured to shear at the location of the groove in the event that a predetermined load rating is exceeded.

19. The apparatus of claim 16, wherein:

the locking body further defines a first annular groove near a junction of the main locking body portion and the secondary locking body portion;

a first annular seal is seated in the first annular groove and is configured to engage the shoulder within each receptacle of the cylindrical sidewall in a sealing relationship therewith;

the locking assembly further comprises a second locking collar coupled to an end portion of the main actuator portion and configured to retain the actuator in a coupled relationship with the locking body, an outer surface of the second locking collar defines a second annular groove; and a second annular seal seated within the second annular groove defined by the second locking collar, such that the second annular seal engages an inner surface of the secondary locking body portion in a sealing relationship therewith.

20. An apparatus for installation to a mandrel or hub disposed in a subsea environment, comprising:

a body having a body longitudinal axis and a cylindrical sidewall extending axially along the body longitudinal axis, the cylindrical sidewall defining one or more receptacles, and a locking system coupled to the body and configured to couple the body to the mandrel or hub, the locking system comprising:

one or more locking assemblies, each locking assembly configured to be received within a respective receptacle and coupled to the cylindrical sidewall, each locking assembly comprising an actuator adjustably coupled to the cylindrical sidewall and configured to move radially toward or away from an angled shoulder surface of the mandrel or hub, the actuator comprising a main actuator portion having an outer surface, an inner surface and an end face, the outer surface of the main actuator portion being adjustably coupled to the cylindrical sidewall, and the inner surface of the main actuator portion defining an actuator locking pin bore;

a remotely operated vehicle (ROV) interface member having an ROV interface member interior surface, wherein the ROV interface member further comprises an exterior ROV interface; and an actuator longitudinal axis, the main actuator portion configured to rotate in a clockwise or a counterclockwise direction about the actuator longitudinal axis to move radially in relation to the mandrel or hub based on the input from an ROV;

a locking pin coupled with the actuator and configured to selectively engage the angled shoulder surface of the mandrel or hub, such that when extended, the locking pin couples the body to the mandrel or hub, the locking pin comprising:

a locking pin head and a locking pin shaft, wherein:

the locking pin head has a first surface and a second surface, the first surface shaped to generally conform to an angled shoulder surface of the mandrel or hub, and the second surface seated against the end face of the main actuator portion; and a locking pin shaft extending from the second surface of the locking pin head and configured to be installed to the actuator locking pin bore;

wherein the locking pin:

defines a groove at a location adjacent a junction of the locking pin head and the locking pin shaft; and is configured to shear at the location of the groove in the even that a predetermined load rating is exceeded.

21. The apparatus of claim 20, wherein:

the cylindrical sidewall further forms a respective shoulder within each receptacle in the cylindrical sidewall;

the locking assembly further comprises a locking body having a main locking body portion and a secondary locking body portion extending from the main locking body portion, the main locking body portion having a main locking body portion exterior surface and a main locking body interior surface;

the locking assembly further comprises a first locking collar configured to couple the locking body to the cylindrical sidewall, such that the first locking collar is coupled with the secondary locking body portion and seated against an interior face of the shoulder and a main locking body interior surface is seated against an exterior face of the shoulder; and an outer cylindrical surface of the cylindrical sidewall further defines each receptacle predominantly in the shape of a rectangle, an outer surface of the main locking body portion of each locking body is defined predominantly in the shape of a rectangle, and the main locking body portion is configured to engage the rectangular portion of the receptacle in the cylindrical sidewall.

22. The apparatus of claim 20, wherein the locking pin defines a vent channel extending through the locking pin head and the locking pin shaft, the vent channel configured to fluidly couple the actuator locking pin bore to the subsea environment.

23. An apparatus for installation to a mandrel or hub disposed in a subsea environment, comprising:

a body having a body longitudinal axis and a cylindrical sidewall extending axially along the body longitudinal axis, the cylindrical sidewall defining one or more receptacles; and a locking system coupled to the body and configured to couple the body to the mandrel or hub, the locking system comprising:

one or more locking assemblies, each locking assembly configured to be received within a respective receptacle and coupled to the cylindrical sidewall, each locking assembly comprising:

a locking body comprising a main locking body portion having a main locking body portion exterior surface defining an annular groove;

an actuator adjustably coupled to the locking body and configured to move radially toward or away from an angled shoulder surface of the mandrel or hub, the actuator comprising a main actuator portion;

a remotely operated vehicle ("ROV") interface member extending from the main actuator portion and having an ROV interface member interior surface, the ROV interface member having an exterior ROV interface; and an actuator longitudinal axis, the main actuator portion configured to rotate in a clockwise or a counterclockwise direction about the actuator longitudinal axis to move radially in relation to the mandrel or hub based on the input from an ROV;

an annular component disposed within the annular groove and protruding therefrom, the annular component configured to engage the ROV interface member interior surface as the actuator is moved radially toward the angled shoulder surface of the mandrel or hub, and the annular component further configured to prevent contact between the ROV interface member interior surface and the main locking body portion exterior surface; and a locking pin integral or coupled with the actuator and configured to selectively engage the angled shoulder surface of the mandrel or hub, such that when extended, the locking pin couples the body and locking assembly to the mandrel or hub.

24. The apparatus of claim 23, wherein:

the main actuator portion has an outer surface, an inner surface, and an end face, the outer surface being adjustably coupled to the locking body, and the inner surface defining an actuator locking pin bore configured to receive therein a locking pin;

the locking pin further includes a locking pin head and a locking pin shaft;

the locking pin head has a first surface and a second surface, the first surface shaped to generally conform to the angled shoulder surface of the mandrel or hub, and the second surface seated against the end face of the main actuator portion; and the locking pin shaft extends from the second surface of the locking pin head, the locking pin shaft configured to be installed to the actuator locking pin bore.

25. The apparatus of claim 23, wherein:

the cylindrical sidewall further comprises a respective shoulder within each receptacle in the cylindrical sidewall;

the locking assembly further comprises a locking body having a main locking body portion and a secondary locking body portion extending from the main locking body portion, the main locking body portion having a main locking body portion exterior surface and a main locking body interior surface;

the locking assembly further comprises:

a first locking collar configured to couple the locking body to the cylindrical sidewall, such that the first locking collar is coupled with the secondary locking body portion and seated against an interior face of the shoulder and a main locking body interior surface is seated against an exterior face of the shoulder; and a second locking collar coupled to an end portion of the main actuator portion and configured to retain the actuator in a coupled relationship with the locking body; and an outer cylindrical surface of the cylindrical sidewall further defines each receptacle predominantly in the shape of a rectangle, an outer surface of the main locking body portion of each locking body is defined predominantly in the shape of a rectangle, and the main locking body portion is configured to engage the rectangular portion of the receptacle in the cylindrical sidewall.

* * * * *